US012421730B2

(12) United States Patent
Gakhar

(10) Patent No.: US 12,421,730 B2
(45) **Date of Patent: *Sep. 23, 2025**

(54) ATTACHMENT CLIP FOR BUILDING SURFACE PANELS AND BUILDING SURFACE PANEL SYSTEM

(71) Applicant: CertainTeed LLC, Malvern, PA (US)

(72) Inventor: Eishaan Gakhar, Ann Arbor, MI (US)

(73) Assignee: CertainTeed LLC, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/959,358

(22) Filed: Oct. 4, 2022

(65) Prior Publication Data

US 2023/0115423 A1 Apr. 13, 2023

Related U.S. Application Data

(63) Continuation of application No. 17/085,371, filed on Oct. 30, 2020, now Pat. No. 11,459,768.

(60) Provisional application No. 63/025,010, filed on May 14, 2020, provisional application No. 62/955,551, filed on Dec. 31, 2019, provisional application No. 62/928,983, filed on Oct. 31, 2019.

(51) Int. Cl.
*E04F 13/08* (2006.01)

(52) U.S. Cl.
CPC ..... *E04F 13/0801* (2013.01); *E04F 13/0846* (2013.01); *E04F 13/0894* (2013.01); *E04F 13/0821* (2013.01)

(58) Field of Classification Search
CPC ..... E04F 13/0801; E04F 13/0846; E04F 13/0894; E04F 13/0821; E04H 4/08; Y10T 428/19
See application file for complete search history.

(56) References Cited

U.S. PATENT DOCUMENTS 2,200,649 A 5/1940 Wardle
2,924,963 A * 2/1960 Taylor ..... E04F 13/0846 52/509
3,019,863 A 2/1962 Kearns
4,002,261 A 1/1977 Litchfield
4,186,979 A 2/1980 Litchfield
(Continued)

FOREIGN PATENT DOCUMENTS

CA 2351266 A1 12/2001
CA 2255245 C 2/2008
(Continued)

OTHER PUBLICATIONS

International Search Report and Written Opinion in PCT/US2020/058201, dated Feb. 2, 2021.
Monarch Metal Fabrication, Cladding—Plank Board Systems (2018).

*Primary Examiner* — Jessie T Fonseca
(74) *Attorney, Agent, or Firm* — McDonnell Boehnen Hulbert & Berghoff LLP

(57) ABSTRACT

The present disclosure relates generally to building surface panel systems, for example, suitable for covering a building surface. The present disclosure relates more particularly to a building surface panel kit for attachment to a support structure. The building surface panel kit includes a clip configured to secure the building surface panel system to the support structure. The kit also includes a first building surface panel having first and second ends, a front face, and a rear face.

17 Claims, 25 Drawing Sheets

(56) References Cited

U.S. PATENT DOCUMENTS

| | | | | |
|---|---|---|---|---|
| 4,263,764 | A * | 4/1981 | Wendt | E04B 2/789 52/713 |
| 4,427,245 | A | 1/1984 | Litchfield | |
| 4,444,524 | A | 4/1984 | Cook | |
| 4,598,504 | A | 7/1986 | Itagaki | |
| 5,363,620 | A | 11/1994 | Liu | |
| 5,411,782 | A | 5/1995 | Jarvis | |
| 5,590,502 | A * | 1/1997 | Wendt | E04B 2/7457 52/489.1 |
| 6,202,965 | B1 | 3/2001 | Chong | |
| 7,090,053 | B2 | 8/2006 | Bothwell | |
| 7,207,145 | B2 | 4/2007 | Stucky | |
| 8,429,870 | B2 | 4/2013 | Chen | |
| 8,979,052 | B2 * | 3/2015 | Uota | E04F 13/0801 403/381 |
| 9,410,566 | B2 | 8/2016 | Kikuchi | |
| 10,041,258 | B2 | 8/2018 | Pervan | |
| RE47,495 | E | 7/2019 | MacKenzie | |
| 11,008,760 | B1 | 5/2021 | Tang | |
| 2002/0046536 | A1 | 4/2002 | Hotta | |
| 2002/0092256 | A1 | 7/2002 | Hendrickson | |
| 2004/0050007 | A1 | 3/2004 | Curatolo | |
| 2005/0102944 | A1 | 5/2005 | Hikai | |
| 2006/0272261 | A1 * | 12/2006 | Ito | E04F 13/0846 52/586.1 |
| 2007/0056238 | A1 | 3/2007 | Albracht | |
| 2007/0175108 | A1 | 8/2007 | Stein | |
| 2010/0084222 | A1 | 4/2010 | Cleveland | |
| 2012/0085062 | A1 | 4/2012 | Neumayr | |
| 2012/0192518 | A1 | 8/2012 | Delforte | |
| 2013/0121758 | A1 | 5/2013 | Joh | |
| 2014/0199117 | A1 * | 7/2014 | Kikuchi | E04F 13/0846 403/380 |
| 2014/0245686 | A1 | 9/2014 | Wielens | |
| 2016/0053491 | A1 | 2/2016 | Fleming | |
| 2018/0179751 | A1 | 6/2018 | Krohmer | |
| 2018/0355607 | A1 | 12/2018 | Parshad | |
| 2020/0217065 | A1 | 7/2020 | Rosan | |
| 2020/0217067 | A1 | 7/2020 | Rosan | |

FOREIGN PATENT DOCUMENTS

| | | | | |
|---|---|---|---|---|
| CH | 700410 | A2 * | 8/2010 | E04F 13/0846 |
| DE | 9316939.6 | U1 | 4/1994 | |
| FR | 3078726 | A1 | 9/2019 | |
| GB | 2249565 | A | 5/1992 | |
| KR | 10-2011-0121873 | A | 11/2011 | |
| KR | 10-2014-0040329 | A | 4/2014 | |

* cited by examiner

ATTACHMENT CLIP FOR BUILDING SURFACE PANELS AND BUILDING SURFACE PANEL SYSTEM

CROSS-REFERENCE TO RELATED APPLICATIONS

This application is a continuation of U.S. patent application Ser. No. 17/085,371, filed Oct. 30, 2020, which claims the benefit of priority of U.S. Provisional Patent Applications Nos. 62/928,983, filed Oct. 31, 2019; 62/955,551, filed Dec. 31, 2019; and 63/025,010, filed May 20, 2020, each of which is hereby incorporated herein by reference in its entirety.

BACKGROUND OF THE DISCLOSURE

1. Field of the Disclosure

The present disclosure relates generally to building surface panel systems for example, suitable for covering the walls or ceilings of buildings. The present disclosure relates more particularly to a building surface panel system that uses clips to secure building surface panels to a support structure.

2. Technical Background

Many building surfaces are constructed with a supporting structure, such as a frame or substrate layer, that is covered with a layer of panels. For example, exterior walls may include an exterior sheathing that is covered with siding that is, or appears to be, wood siding, brick, or stone. Other walls may include building surface panels attached to a frame or furring strips.

Typically, building surface panels are attached to the supporting structure using fasteners that extend through the building surface panels. The fasteners may securely hold the entire panel to the support structure or may hold one side of the panel to the supporting structure while the opposing side of the panel is attached to an adjacent panel.

The present inventor has determined that the use of fasteners extending through panels is only effective with panels having a certain configuration. As a result, most building surface panels of a particular type have a similar shape and construction. The present inventor has determined that an alternative system to secure building surface panels to a support structure would be attractive to builders and allow greater versatility of building surface panel systems.

SUMMARY OF THE DISCLOSURE

In one aspect, the present disclosure provides a building surface panel kit for attachment to a support structure, the building surface panel kit comprising:

- a first building surface panel having a first end, a second end, a front face, a rear face, a first edge including a groove, and a second edge including a tongue configured to be inserted into the groove of another building surface panel; and
- a first attachment clip configured to secure the first building surface panel to the support structure, the first attachment clip including:
  - a clip body,
  - an attachment surface coupled to the clip body and configured to be secured to the support structure, and
  - a retaining fastener coupled to the clip body and configured to engage an edge of the first building surface panel.

In another aspect, the disclosure provides a method of securing a building surface panel kit to a support structure, the method comprising:

- a support structure; and
- attaching a first group of attachment clips to a support structure, each of the attachment clips in the first group of attachment clips having a retaining fastener including a ridge configured to engage a groove of a building surface panel;
- securing a first building surface panel to the first group of attachment clips by placing the ridge of each attachment clip into a groove on a first edge of the first building surface panel;
- securing a second group of attachment clips to a second edge of the first building surface panel, each of the attachment clips in the second group of attachment clips having a retaining fastener including a notch, wherein securing the second group of attachment clips to the second edge of the first building surface panel includes placing a tongue located on the second edge of the first building surface panel into each notch of a respective attachment clip of the second group of attachment clips; and
- attaching the second group of attachment clips to the support structure.

In another aspect, the disclosure provides another building surface panel kit for attachment to a support structure, the building surface panel kit comprising:

- a first connector clip including:
  - an attachment platform configured to be secured to the support structure,
  - a base wall secured to the attachment platform, and
  - a first projection extending laterally from a first side of the base wall; and
- a first building surface panel having a first end, a second end, a first side, a second side, a front face, and a rear face, the first building surface panel comprising a structural body including a first perimeter wall section at the first end that surrounds a recess configured to receive the first projection of the first connector clip.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventor has noted that conventional mechanisms for attaching building surface panels to a support structure limit conventional panels to certain configurations. The present inventor has determined that an alternative system to secure building surface panels to a support structure would be attractive to builders and allow greater versatility of building surface panel systems. Embodiments of the disclosure relate to various types of building surface panels. For example, in some embodiments, the building surface panels are siding panels configured to cover an exterior wall surface. In other embodiments, the building surface panels are wall panels configured to cover an interior wall surface. Still in other embodiments, the building surface panels are ceiling panels configured to cover the ceiling of an interior space.

Accordingly, one aspect of the disclosure is a building surface panel kit for attachment to a support structure. The building surface panel kit includes a first connector clip and a first building surface panel. The first connector clip includes an attachment platform configured to be secured to the support structure, a base wall secured to the attachment platform, and a first projection extending laterally from a first side of the base wall. The first building surface panel has a first end, a second end, a first side, a second side, a front face, and a rear face. The first building surface panel also includes a structural body including a first perimeter wall section at the first end that surrounds a recess configured to receive the first projection of the first connector clip.

Figure 1A:
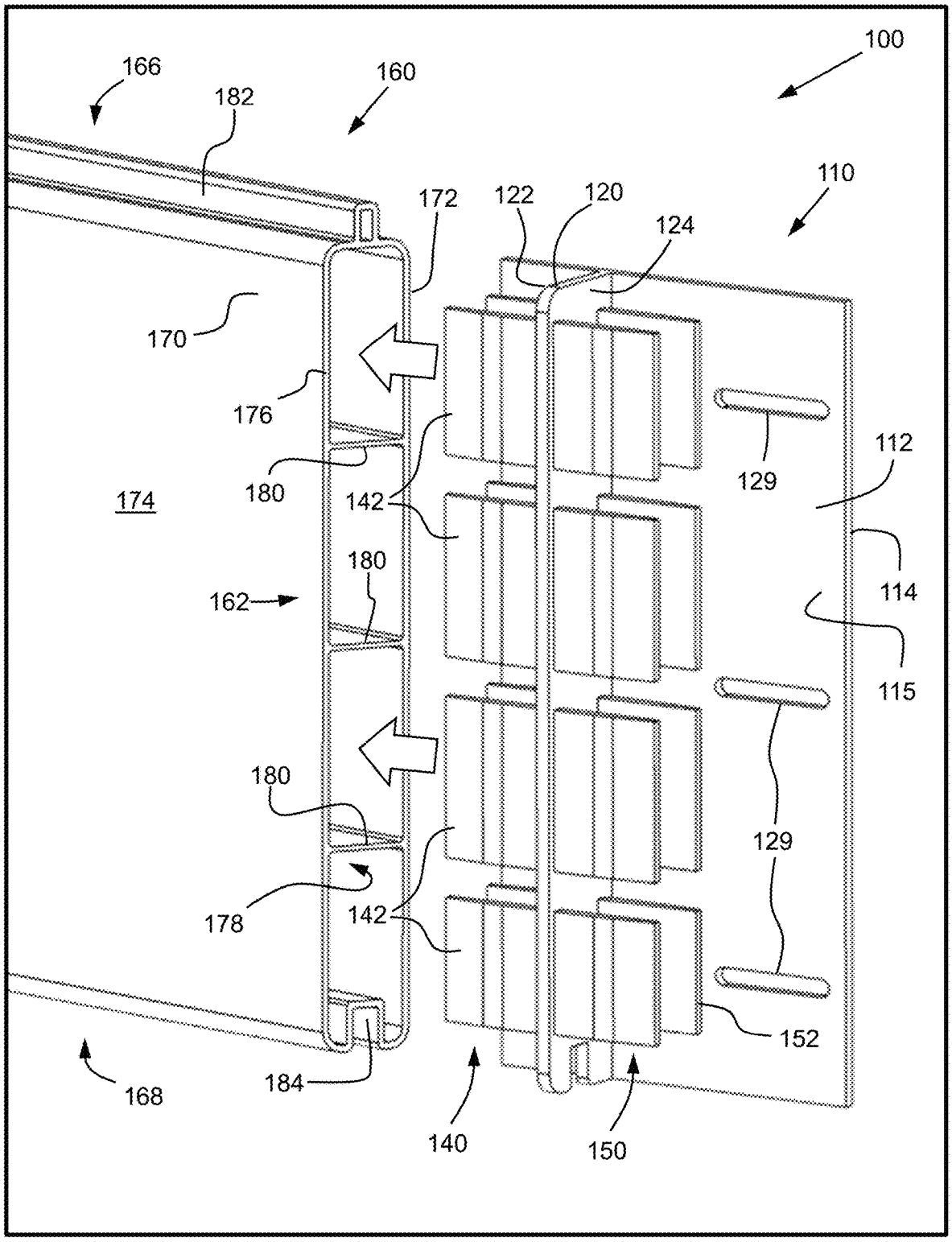
FIG. 1A is a schematic perspective view of elements of a building surface panel kit according to an embodiment of the disclosure.

The foregoing two components of such a building surface panel kit are shown in perspective view in FIG. 1A. Building surface panel kit 100 includes a first connector clip 110 and a first building surface panel 160. To show the details of first connector clip 110 and the connecting elements of first building surface panel 160, only a portion of first building surface panel 160, toward an end thereof, is shown. First connector clip 110 includes an attachment platform 112 that is configured to be secured to a support structure. In particular, attachment platform 112 is planar and includes a flat rear face 114 that is adapted to abut a corresponding flat surface of a support structure. In other embodiments, the attachment platform engages the support structure in another manner.

First connector clip 110 also includes a base wall 120 secured to attachment platform 112. Base wall 120 extends directly from a front face 115 of attachment platform 112 and includes a first side 122 and a second side 124. First connector clip 110 further includes a first projection 140 that extends laterally from the first side 122 of base wall 120.

First building surface panel 160 has two ends including first end 162, a first side 166, a second side 168, a front face 170 and a rear face 172. In the illustrated configuration, first side 166 is located at the top of building surface panel 160 and second side 168 is located at the bottom of building surface panel 160. However, the orientation of building surface panel 160 could be flipped, such that first side 166 is located at the bottom. First building surface panel 160 is formed by a structural body 174 that includes a first perimeter wall section 176 at first end 162 that surrounds a recess 178. In an installed configuration, the first projection 140 of first connector clip 110 is inserted into recess 178 such that first perimeter wall section 176 surrounds first projection 140.

In some embodiments, the attachment platform of the connector clip is aligned with the base wall. For example, in first connector clip 110, base wall 120 substantially spans the height of attachment platform 112 and extends outward therefrom. In other embodiments, however, the base wall and attachment platform are not aligned. For example, in some embodiments, the base wall hangs downward from the attachment platform.

In certain embodiments of the building surface panel kit as otherwise described herein, the first building surface panel is hollow and the first perimeter wall section is part of a perimeter wall that extends the length of the panel. For example, the structural body 174 of first building surface panel 160 has a hollow interior that spans the length of first building surface panel 160. In particular, the structural body 174 includes a perimeter wall the extends the length of first building surface panel 160 and includes first perimeter wall section 176 at first end 162 of first building surface panel 160. In other embodiments, an interior of the first building surface panel is solid. For example, in some embodiments, the structural body of the first building surface panel includes a solid plank that extends along the majority of the length of the first building surface panel, and the first perimeter wall section that engages with the connector clip extends from the solid plank at the first end of the first building surface panel.

In certain embodiments of the building surface panel kit as otherwise described herein, the structural body of the first building surface panel is an extruded member that includes the first perimeter wall section. For example, structural body 174 of first building surface panel 160 is an extruded member, where the entire length of the first building surface panel 160 has substantially the same cross section. Thus, extruded structural body 174 includes a perimeter wall that spans the length of first building surface panel 160 and includes first perimeter wall section 176.

In certain embodiments of the building surface panel kit as otherwise described herein, the first projection of the first connector clip includes a plurality of projection portions that are separated by gaps along a height of the first connector clip. For example, first projection 140 of first connector clip 110 includes four projection portions 142 that are separated by gaps along the height of first connector clip 110. The top three projection portions 142 each have the same height, while the bottom projection portion 142 is somewhat shorter than the others, as explained in more detail below.

In certain embodiments of the building surface panel kit as otherwise described herein, the structural body of the first building surface panel includes at least one web extending between the front face and the rear face. Further, in certain embodiments of the building surface panel kit as otherwise described herein, each web of the at least one web is configured to be received in a respective gap between the projection portions. For example, structural body 174 of first building surface panel 160 includes three webs 180 that extend across the thickness of first building surface panel 160 from an inner surface of the perimeter wall at the front face 170 to an inner surface of the perimeter wall at the rear face 172. The three webs 180 of first building surface panel 160 divide the recess 178 within the first perimeter wall section 176 into four hollow sections. When first projection 140 is inserted into recess 178, the four projection portions 142 are respectively inserted into the four hollow sections of recess 178 with the webs 180 respectively positioned in the gaps between projection portions 142.

In certain embodiments of the building surface panel kit as otherwise described herein, the first connector clip is a joint connector clip and further comprises a second projection extending laterally from a second side of the base wall in a direction that is opposite the first projection. Such a joint connector clip is configured to secure the ends of two building surface panels together so as to form a continuous elongate structure. Accordingly, two building surface panels connected by a joint connector clip may behave as a single building surface panel. For example, first connector clip 110 is a joint connector clip that includes a second projection 150 extending from the second side 124 of base wall 120. The second projection 150 has a similar configuration to first projection 140, but extends in the opposite direction as first projection 140. In other embodiments, the second projection may have any of the features or configurations described herein with respect to the first projection. Further, while in some embodiments the first projection and the second projection may have identical configurations that are mirror images of one another, in other embodiments, the first and second projections have different configurations.

Figure 2:
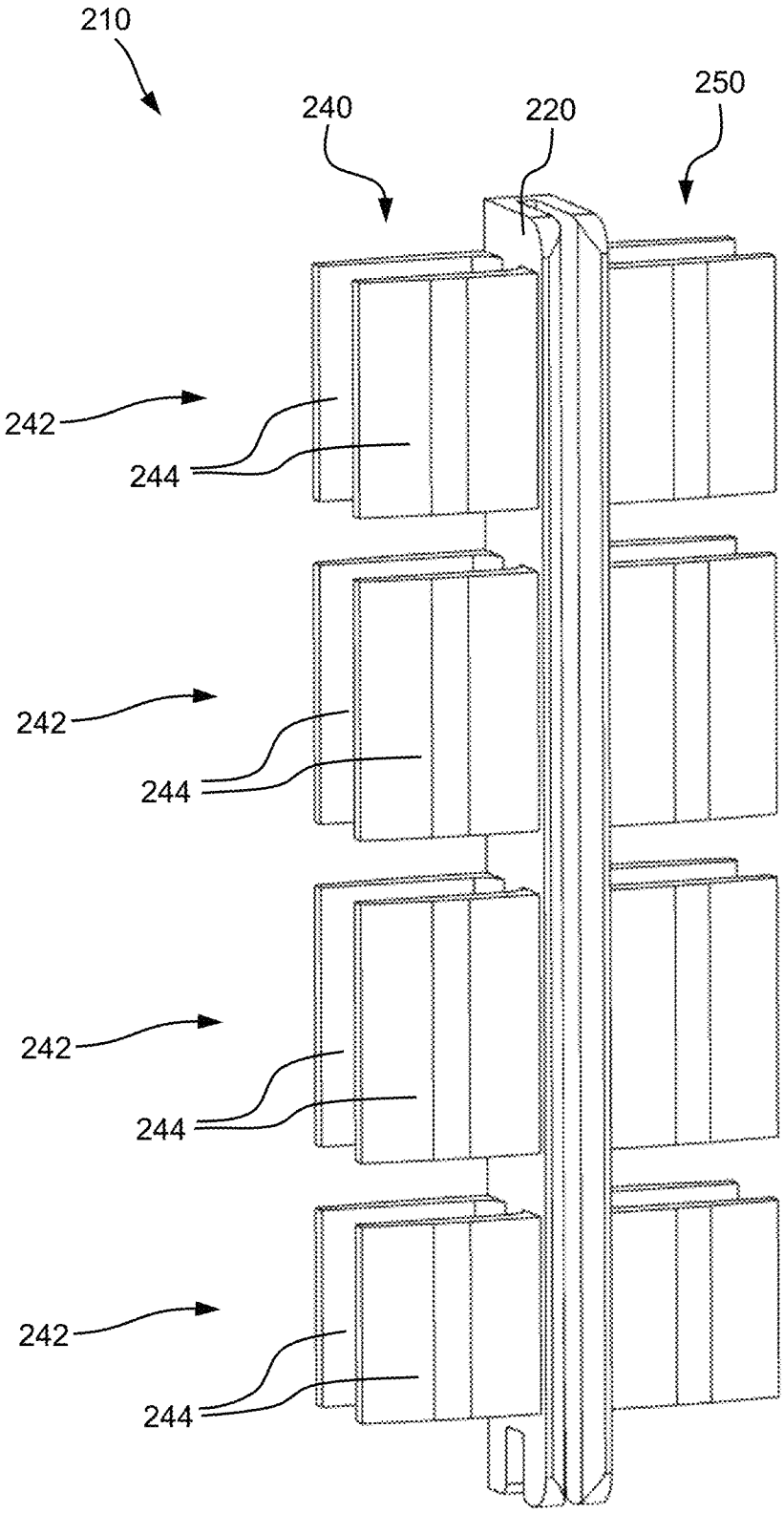
FIG. 2 is a schematic perspective view of a connector clip according to another embodiment of the disclosure.

In certain embodiments of the building surface panel kit as otherwise described herein, the first connector clip does not include an attachment platform. For example, in some embodiments, the first connector clip is a joint connector clip that joins two building surface panels together without attaching the panels to a support structure. Such a first connector clip is shown in FIG. 2. First connector clip 210 includes a base wall 220 and a first projection 240 that extends laterally from the base wall 220. First connector clip 210 also includes a second projection 250 that extends laterally from base wall 220 in a direction opposite to the direction of first projection 240. The first projection 240 includes four projection portions 242 that are separated along a height of the first connector clip 210. The two projection portions 242 are each formed of a pair of tabs 244 at the front and rear sides of first projection 240. In contrast to first connector clip 110, first connector clip 210 does not include an attachment platform. Instead, first connector clip 210 is configured to join two similar building surface panels to one another that are secured to a support structure using other clips or fasteners.

Figure 1B:
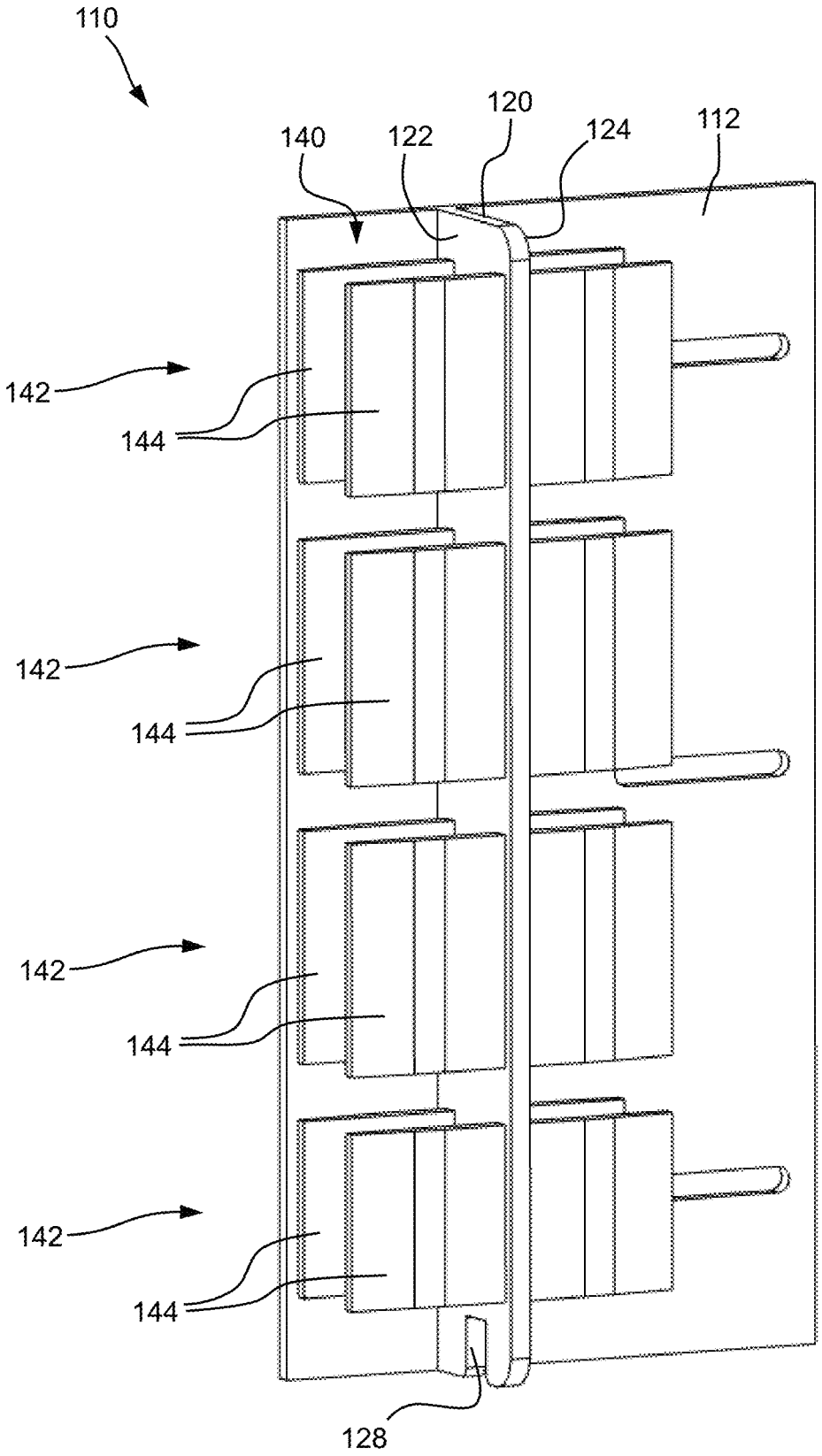
FIG. 1B is a schematic perspective view of a connector clip according to the building surface panel kit of FIG. 1A.

In certain embodiments of the building surface panel kit as otherwise described herein, the first projection of the first connector clip is hollow. Further, in certain embodiments of the building surface panel kit as otherwise described herein, the first projection includes a plurality of tabs extending from the base wall. For example, first connector clip 110 includes a hollow first projection 140 that is formed of a plurality of tabs, as illustrated in greater detail in FIG. 1B. As shown in FIG. 1B and explained above, first projection 140 of first connector clip 110 includes four projection portions 142. Further, each projection portion 142 of first projection 140 is formed by two tabs 144 including a front tab and a rear tab that are separated by a hollow space. The tabs 144 extend laterally from base wall 120 and are configured to be inserted into the recess 178 of first building surface panel 160.

Figure 3:
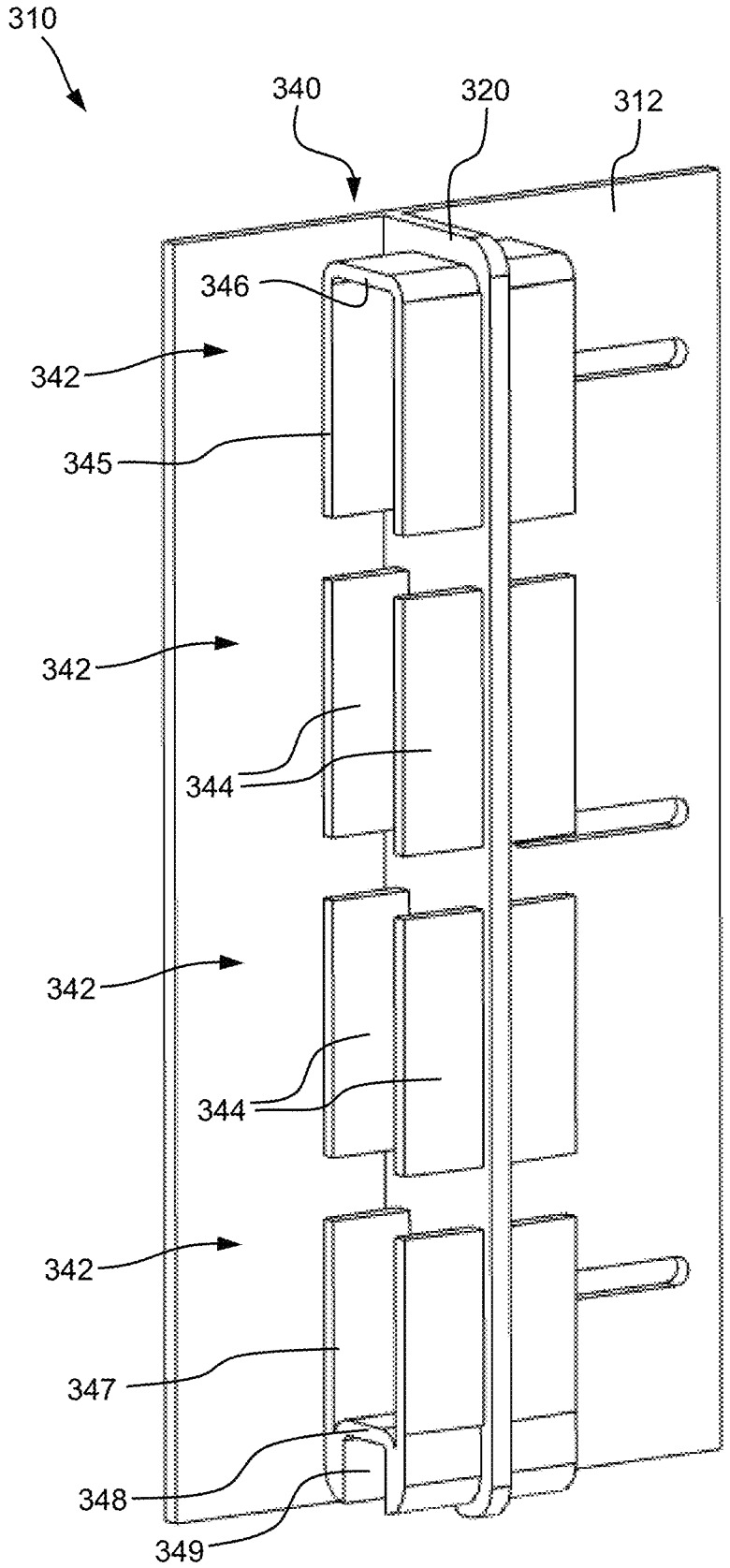
FIG. 3 is a schematic perspective view of a connector clip according to another embodiment of the disclosure.

FIG. 3 shows another embodiment of a connector clip 310 that includes a first projection 340 that has a hollow configuration. Connector clip 310 includes an attachment platform 312 configured to be secured to a support structure and a base wall 320 that extends outward therefrom. Further, connector clip 310 also includes a first projection 340 that extends laterally from base wall 320. Similar to connector clip 110, first projection 340 of connector clip 310 includes four projection portions 342 that are separated by gaps along the height of first projection 340. The two central projection portions 342 are both formed of a pair of tabs 344 at the front and rear sides of first projection 340. In addition, the top projection portion 345 includes an upper end cap 346 that encloses the hollow space within the respective top projection portion 345. Similarly, the bottom projection portion 347 includes a lower end cap 348 that also encloses the hollow space within the bottom projection portion 347.

Figure 4:
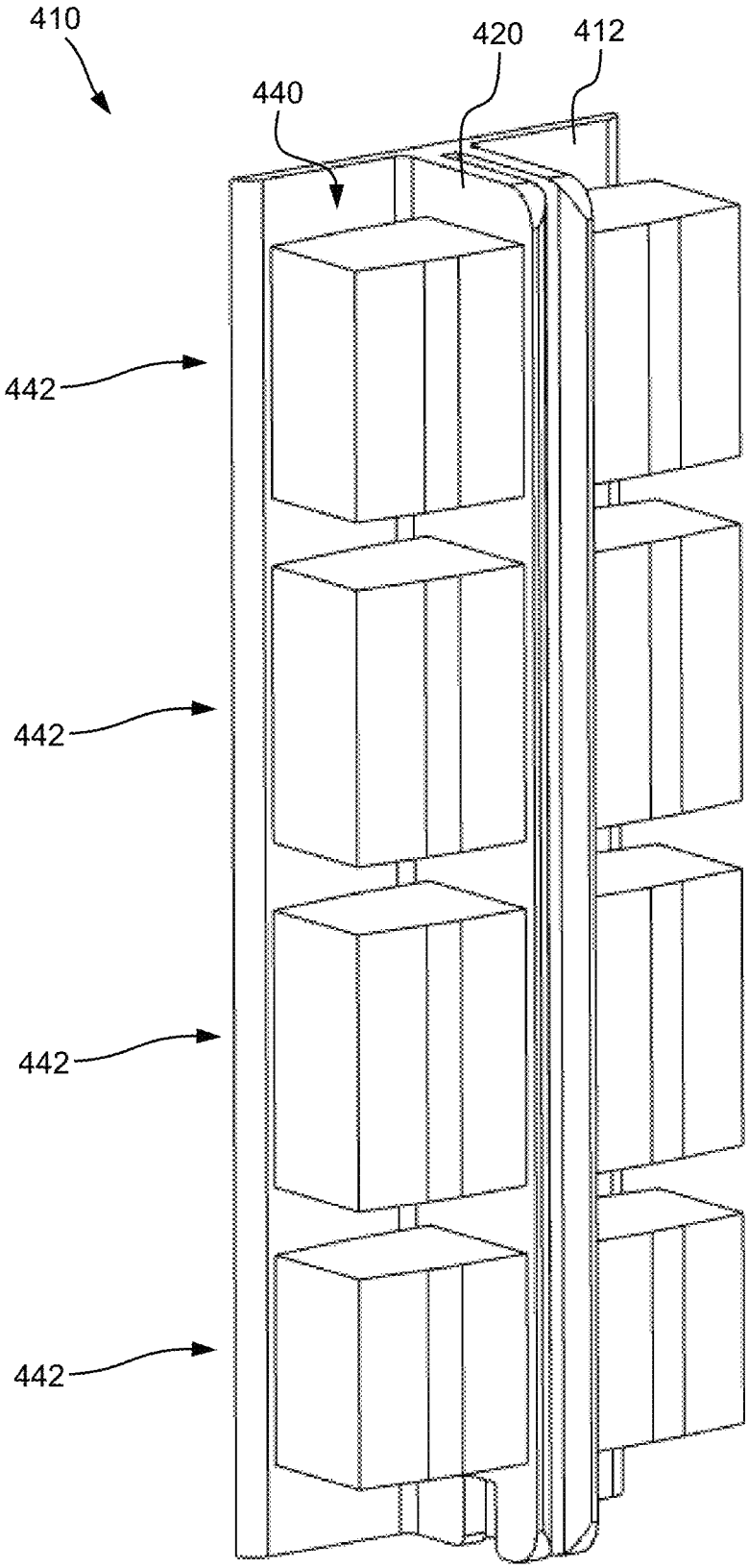
FIG. 4 is a schematic perspective view of a connector clip according to yet another embodiment of the disclosure.

In other embodiments, the first projection of the connector clip is not hollow. FIG. 4 illustrates such an embodiment. Connector clip 410 includes an attachment platform 412 configured to be secured to a support structure and a base wall 420 that extends outward therefrom. A first projection 440 extends laterally from base wall 420 and includes four projection portions 442 that are separated by gaps along the height of first projection 440. Each of the four projection portions 442 is solid from a front surface of the first projection 440 to a back surface of the first projection 440.

In certain embodiments of the building surface panel kit as otherwise described herein, the first building surface panel includes a tongue along the first side and a groove along the second side. For example, first building surface panel 160, as shown in FIG. 1A includes a tongue 182 along first side 166 and a groove 184 along second side 168. The tongue and groove configuration of first building surface panel 160 allows two adjacent panels to interlock along the sides of the panels. For example, tongue 182 along first side 166 of first building surface panel 160 is configured to fit into a corresponding groove of a neighboring building surface panel disposed adjacent to first side 166. Similarly, groove 184 along second side 168 of first building surface panel 160 is configured to receive a corresponding tongue of a neighboring building surface panel disposed adjacent to second side 168. Accordingly, a group of building surface panels having a similar form to first building surface panel 160 can form an interlocking surface, which enhances the structural stability of the surface. In particular, the interlocking tongue and groove configuration prevents the first building surface panel 160 from separating from the support structure by securing the first building surface panel 160 to neighboring panels.

In some embodiments, the overall height of the first projection is configured to avoid interfering with the groove of the first building surface panel. For example, as shown in FIG. 1A first projection 140 on connector clip 110 extends down to a lower edge that is above the groove 184 of first building surface panel 160 so as not to interfere with groove 184 when first projection 140 is inserted into recess 178. In other embodiments, the first projection of the first connector clip includes a slot configured to accommodate the groove of the first building surface panel. For example, first projection 340 of first connector clip 310, shown in FIG. 3, includes a slot 349 in order to fit around the perimeter wall surrounding the groove in the first building surface panel (FIG. 1A).

In certain embodiments of the building surface panel kit as otherwise described herein, the base wall of the first connector clip includes a notch configured to accommodate a tongue of an adjacent building surface panel. For example, in connector clip 110, base wall 120 includes a notch 128 that is adapted to receive the tongue of a neighboring building surface panel. Thus, with first building surface panel 160 coupled to connector clip 110, the groove 184 in first building surface panel 160 may receive the tongue of a neighboring building surface panel and the notch 128 in base wall 120 of connector clip 110 may also receive the tongue of the neighboring building surface panel. Accordingly, the tongue of the neighboring building surface panel can extend across the groove 184 of first building surface panel 160 through the notch 128 of connector clip 110 and, further, to a groove of an additional building surface panel attached to a second projection of connector clip 110, as described in more detail below.

In certain embodiments of the building surface panel kit as otherwise described herein, the first connector clip includes an aperture through the attachment platform that is configured to receive a mechanical fastener for securing the first connector clip to the support structure. For example, first connector clip 110 includes three apertures 129 that extend through attachment platform 112. The apertures 129 may be used to attach the first connector clip 110 to a support structure, for example using screws or nails that pass through the apertures 129 and penetrate the support structure. In other embodiments, the connector clip may include more or fewer apertures. Further, while first connector clip 110 includes all three apertures 129 on the side of base wall 120 that is opposite first projection 140, in other embodiments the apertures are on the same side as the first projection. Further, in other embodiments, the apertures are disposed on both sides of the base wall.

In other embodiments, the attachment platform of the first connector clip does not include any apertures. For example, in some embodiments the attachment platform includes indicia or indentations that indicate a suggested location for a mechanical fastener to pass through the attachment platform, but the attachment platform does not include an aperture therethrough. Thus, to mount such a first connector clip to the support structure, the installer may drill or nail through the first connector clip at the location of the indicia or indentation. Furthermore, in some embodiments the first connector clip is configured to be attached to the support structure using another type of fastener, such as adhesive.

In certain embodiments of the building surface panel kit as otherwise described herein, the aperture is a slot so as to allow the first connector clip to move laterally along the support structure. For example, in some embodiments, the aperture through the attachment platform of the first connector clip is a slot that extends laterally in the same direction as the first projection. For example, the attachment platform 112 of first connector clip 110 includes apertures 129 that are in the form of slots that extend laterally in the same direction of extension as the first projection 140. The slot shape of the apertures 129 allows the first connector clip 110 to shift laterally after it is secured to the support structure using mechanical fasteners. Specifically, the mechanical fasteners can move laterally along the slot. This allows adjustment between the first connector clip 110 and the support structure. Accordingly, when the first connector clip 110 is connected to the first building surface panel 160, if the first building surface panel 160 expands or contracts, the first connector clip 110 can move laterally to accommodate the expansion or contraction.

Alternatively, in some embodiments the first connector clip accommodates expansion or contraction through a sliding element within the connector clip. For example, in some embodiments, the base wall is connected to the attachment platform through a sliding connection. Thus, the attachment platform may be fixedly secured to the support structure while the base wall and first projection can slide laterally over the attachment platform. For example, in some embodiments, the base wall is secured to the attachment platform on a rail so as to allow lateral movement over the attachment platform. Accordingly, as the first building surface panel expands or contracts, the base wall and first projection can slide laterally with respect to the attachment platform and support structure in order to accommodate the expansion or contraction of the first building surface panel.

In certain embodiments of the building surface panel kit as otherwise described herein, the aperture through the attachment platform is positioned further from the base wall than a distal end of the first projection. For example, in some embodiments, the first projection extends laterally outward from the base wall, and has a proximal end attached to the base wall and a distal end that is remote from the base wall. To allow easy access to the apertures for installation of mechanical fasteners, the apertures in the attachment platform are positioned further from the base wall than the distal end of the first projection. FIG. 1A shows a similar configuration with respect to a second projection 150, which is explained in more detail below. Second projection 150 extends from base wall 120 to a distal end 152, and apertures 129 are positioned further from base wall 120 than the distal end 152 of second projection 150.

Figure 5:
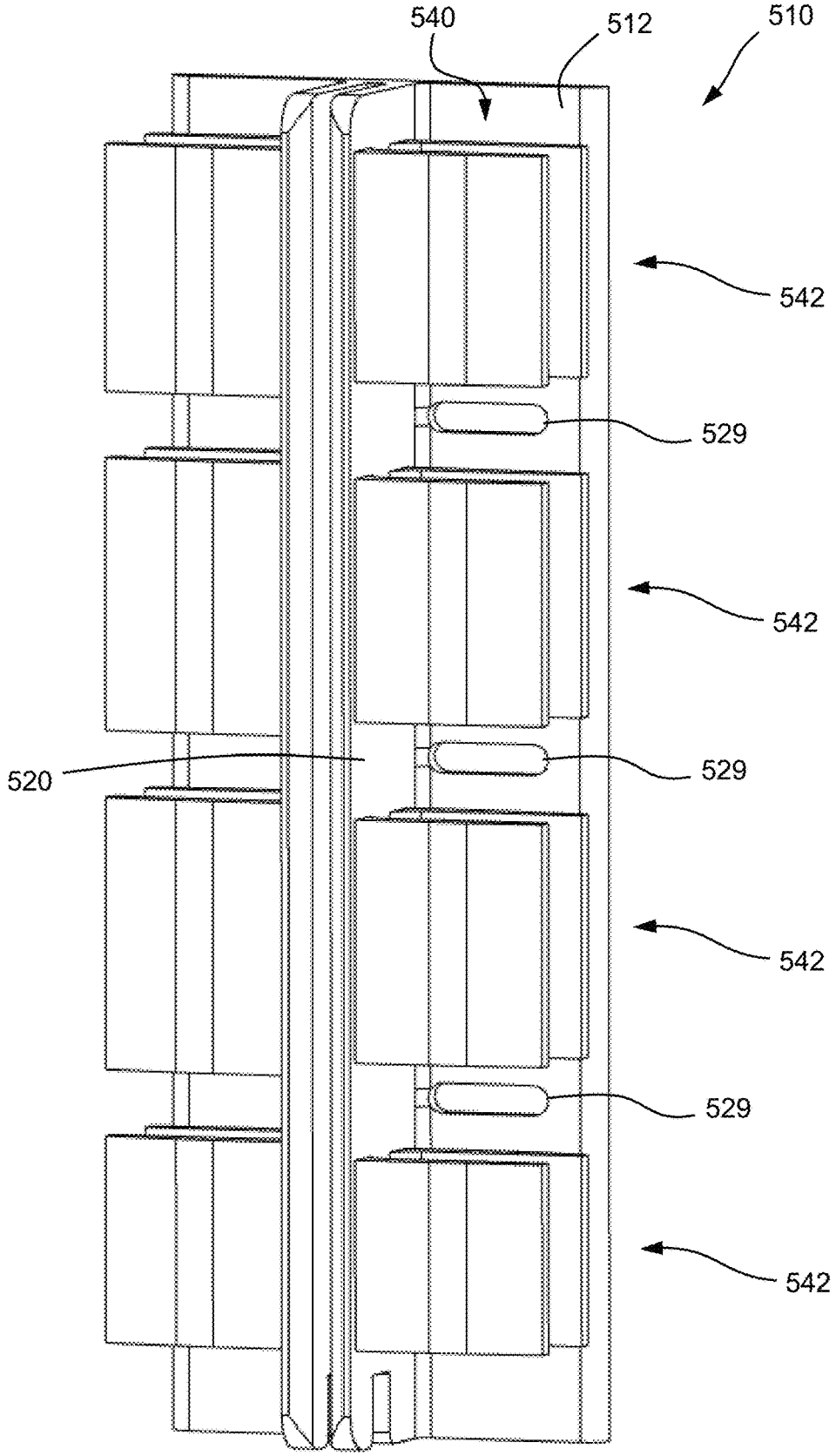
FIG. 5 is a schematic perspective view of a connector clip according to still another embodiment of the disclosure.

On the other hand, in certain embodiments of the building surface panel kit as otherwise described herein, the first projection of the first connector clip includes a plurality of projection portions that are separated by gaps along a height of the first connector clip, and the aperture through the attachment platform is aligned with a respective gap in the first projection. For example, such a first connector clip is shown in FIG. 5. First connector clip 510 includes an attachment platform 512 configured to be secured to a support structure and a base wall 520 that extends outward therefrom. First connector clip 510 also includes a first projection 540 that extends laterally from base wall 520. Notably, first projection 540 of first connector clip 510 extends from the right side of base wall 520, whereas in the embodiments described above, the first projection extended from the left side of the respective base wall. It should be understood that either the left side or the right side of the base wall may be identified as the first side, and thus the first projection may extend from either the right side or the left side of the base wall in embodiments of the disclosure. (Likewise, the building surface panel system also may be rotated so that the first projection extends upward or downward from the base wall.) First projection 540 of first connector clip 510 includes four projection portions 542 that are separated by gaps along the height of first projection 540. Further, apertures 529 extend through attachment platform 512. In order to allow access to apertures 529 for inserting a mechanical fastener therethrough, the apertures 529 may be positioned in the gaps between the projection portions 542.

In certain embodiments of the building surface panel kit as otherwise described herein, the attachment platform comprises a first portion and a second portion that is connectable to the first portion, the base wall is secured to the first portion, and the aperture extends through the second portion. Accordingly, the first portion may be installed on the support structure using mechanical fasteners or other fasteners, and the second portion may be attached to the first portion after installation of the first portion onto the support structure. Thus, the base wall and any projections extending therefrom can be installed after the first portion of the attachment platform is secured to the wall. The connection between the first portion of the attachment platform and the second portion of the attachment platform can be permanent or removable.

Further, in other embodiments, the base wall is attachable to the attachment platform. Thus, the attachment platform may be initially secured to the support structure using mechanical fasteners or other fasteners, and the base wall and any projections extending therefrom may be attached to the attachment platform after it is secured to the support structure. Accordingly, interference between the projections and installation onto the support structure can be avoided. The connection between the base wall and the attachment platform can be permanent or removable.

In certain embodiments of the building surface panel kit as otherwise described herein, the front face of the first building surface panel includes a textured contour. Further, in certain embodiments of the building surface panel kit as otherwise described herein, the textured contour of the front face of the first building surface panel replicates a cut wooden plank. For example, in some embodiments, the front face of the first building surface panel has a surface texture having a contour that imitates wood grain. In other embodiments, the front face of the first building surface panel has a surface texture with a contour that imitates a masonry product, such as stone or brick. Still in other embodiments, the front face of the first building surface panel has a surface texture that enhances acoustic performance of the building surface panel. In other embodiments, the front face of the first building surface panel has a contour in a geometric patter. Further, in other embodiments, the front face of the first building surface panel is smooth.

In some embodiments, the front face of the first building surface panel has a first textured contour and the rear face has a second textured contour that is different form the first textured contour. Further, in some embodiments, the front face of the first building surface panel has a first color and the rear face has a second color that is different from the first color. Such configurations allow the first building surface panel to be reversible, such that the visible face of the building surface panel is selectable. Applicable methods for making a building surface panel according to the disclosure are set forth, for example, in U.S. Pat. No. 8,955,281, which is incorporated by reference herein in its entirety.

In certain embodiments of the building surface panel kit as otherwise described herein, the first projection of the first connector clip is configured to form a friction fit in the recess of the first building surface panel. For example, in some embodiments, the thickness of the first projection between the front side of the first projection and the rear side of the first projection is sized at or very slightly less than the width of the recess in the first building surface panel, such as a difference between 1 and 20 thousandths of an inch. Accordingly, when the first projection of the first connector clip is inserted into the recess of the first building surface panel, the first projection engages the first building surface panel with a tight friction fit such that removal of the connector clip from the first building surface panel requires significant force and the assembly of the first building surface panel and the first connector clip move as a unit. As an example, first connector clip 110 of kit 100 has a friction fit with first building surface panel 160 when the first projection 140 of first connector clip 110 is inserted into the recess 178 of first building surface panel 160.

In other embodiments, the first projection includes a protrusion for forming a snap fit connection in a recess of the first building surface panel. The term snap fit, as used herein, is defined as a connection between components where at least one of the components undergoes a deflection as the components are connected. Accordingly, if the connection is detachable, a corresponding deflection is needed in order to disconnect the assembled components. Such a snap fit connection can provide a relatively stable attachment without the need for any additional fasteners. The deformation that occurs may be elastic, such that the components return to their original shape after the connection is made or after the components are disconnected. Alternatively, the deformation can be plastic and a permanent connection can be established. Accordingly, in some embodiments, the protrusion on the first projection undergoes a deflection as the first projection is inserted into the recess at the first end of the first building surface panel.

Figure 6A:
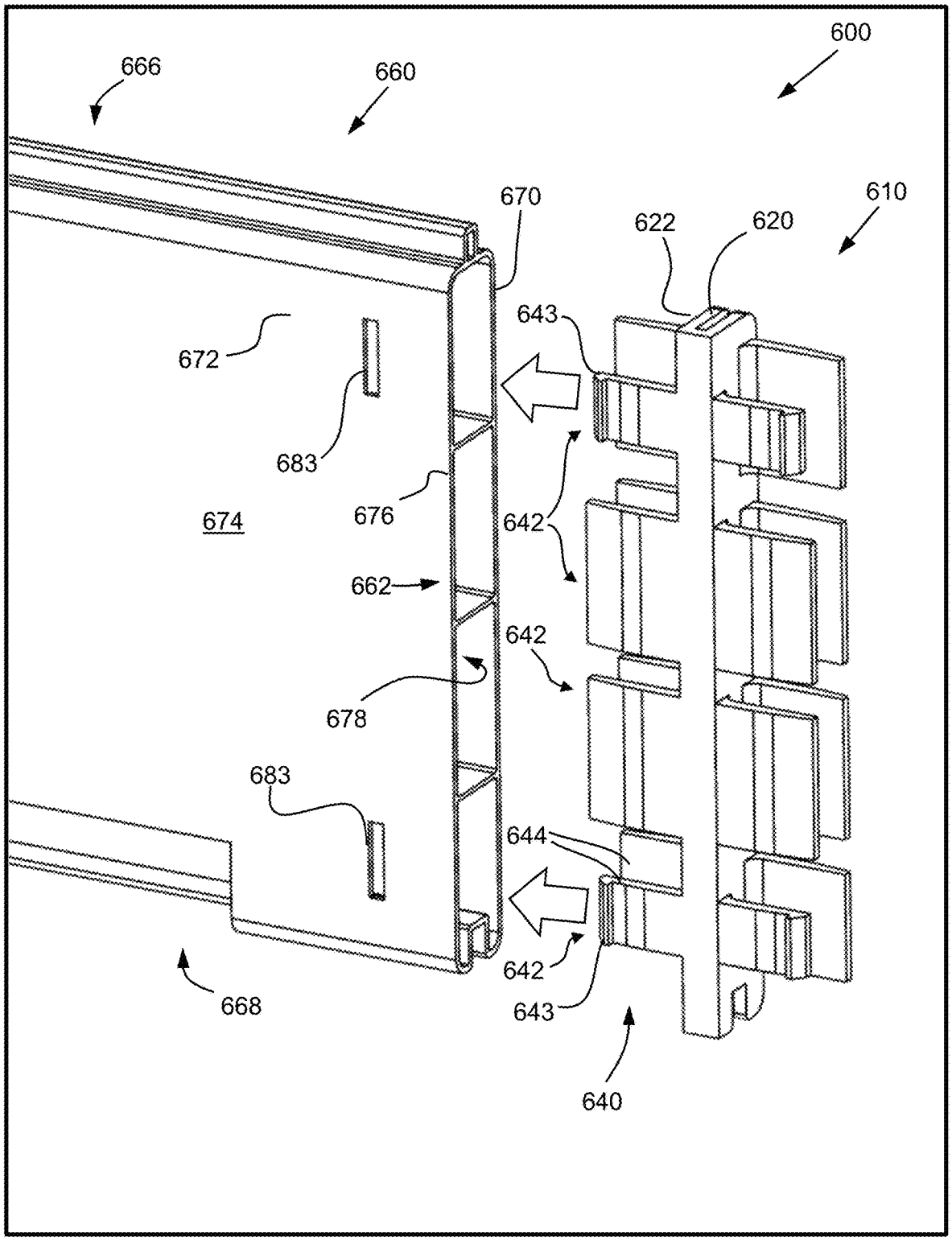
FIG. 6A is a schematic perspective view of elements of a building surface panel kit according to another embodiment of the disclosure in a first position.
Figure 6B:
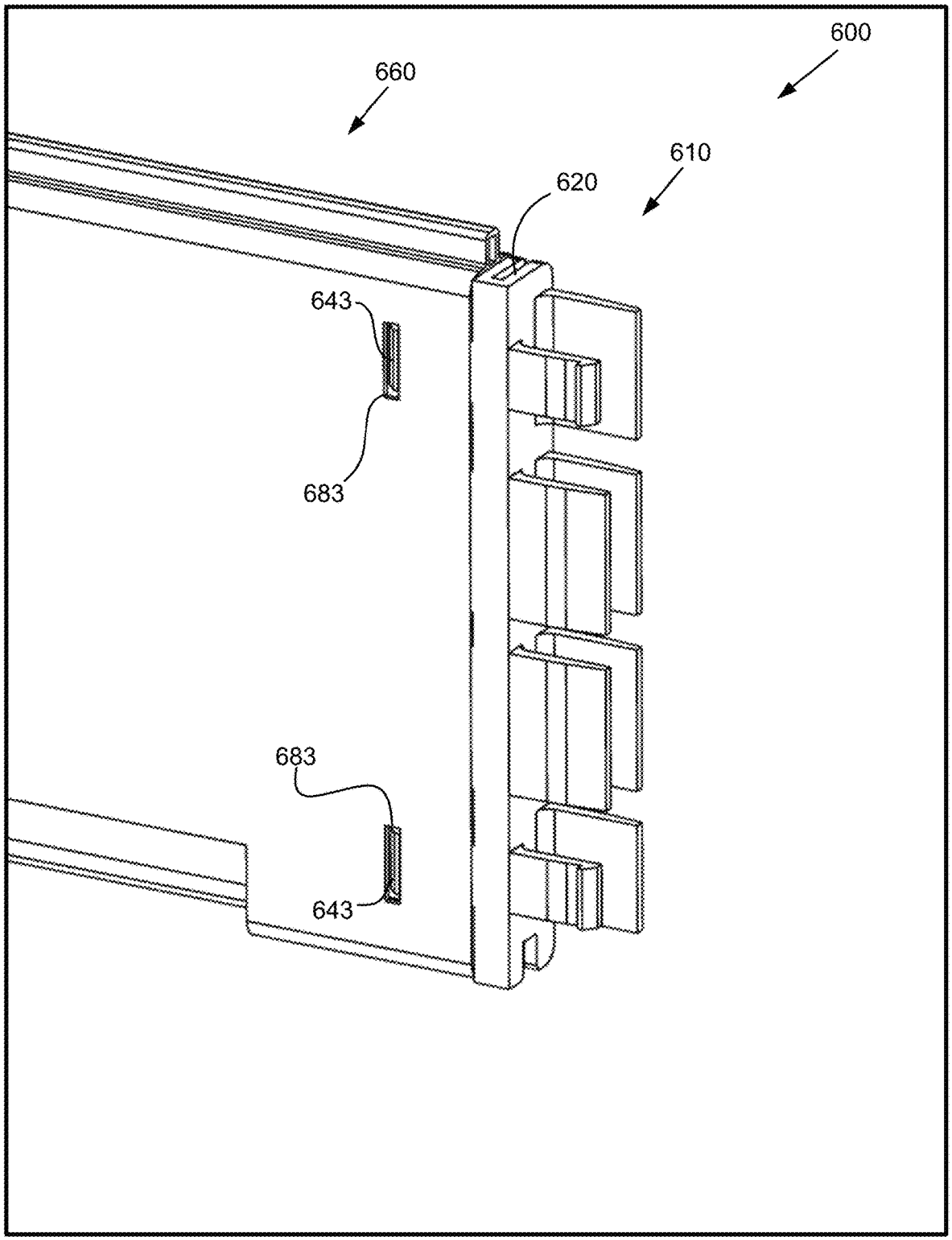
FIG. 6B is a schematic perspective view of the building surface panel kit of FIG. 6A in a second position.

An example of such an embodiment is shown in FIGS. 6A and 6B. Building surface panel kit 600 includes a first connector clip 610 and a first building surface panel 660. FIGS. 6A and 6B show the rear side of first connector clip 610 and first building surface panel 660 to illustrate the connecting elements thereof. Moreover, to show the details of first connector clip 610 and the connecting elements of first building surface panel 660, only a portion of first building surface panel 660, toward an end thereof, is shown.

First connector clip 610 includes a base wall 620 and a first projection 640 that extends laterally from a first side 622 of base wall 620. First building surface panel 660 has two ends including first end 662, a first side 666, a second side 668, a front face 670 and a rear face 672. First building surface panel 660 is formed by a structural body 674 that includes a first perimeter wall section 676 at first end 662 that surrounds a recess 678. In an installed configuration, the first projection 640 of first connector clip 610 is inserted into recess 678 such that first perimeter wall section 676 surrounds first projection 640. Further, the first projection 640 of first connector clip 610 includes a protrusion 643 configured to form a snap fit connection within the first building surface panel 660.

Further, in some embodiments, the recess at the first end of the first building surface panel includes a catch to receive the protrusion. For example, in some embodiments, the protrusion is in the form of a hook and the catch is in the form of a hole in the first perimeter wall section that surrounds the recess at the first end of the first building surface panel. For example, protrusion 643 of first projection 640 is in the form of a hook. Likewise, first building surface panel 660 includes a catch 683 in the form of a hole in the first perimeter wall section 676 that surrounds first recess 678. Specifically, the rear face 672 of first building surface panel 660 includes a hole 683 configured to receive protrusion 643 so as to secure first connector clip 610 to first building surface panel 660. When the first projection 643 is inserted into the recess 678 in the first building surface panel 660, the protrusion 643 engages with the hole 683 to form a snap fit connection, as shown in FIG. 6B. In some embodiments, the protrusion is configured to engage a hole formed by a nail slot punch. Accordingly, the catch, in the form of the hole, can be provided in the building surface panel where needed. In other embodiments, the hole is prefabricated in the building surface panel. Still, in other embodiments, the catch is in the form of a ridge or lip that engages the protrusion when the first projection is inserted into the first building surface panel.

In some embodiments, the first connector clip includes a plurality of projection portions and each of a group of the projections portions includes a protrusion configured to form a snap fit connection. For example, first connector clip 610 includes a plurality of projection portions 642 that are each configured to be received in the recess 678 of first building surface panel 610. Further, the upper and lower projection portions 642 each include a protrusion 643 configured to form a snap fit connection by engaging a corresponding catch 683 in the first building surface panel 660. In some embodiments, as in first connector clip 610, only some of the projection portions include a protrusion for a snap-fit connection. In other embodiments, each of the projection portions includes a protrusion to form a snap-fit connection.

In some embodiments, each of the projection portions of the first connector clip is formed of a pair of tabs and the protrusion for forming a snap-fit connection is provided on a tab. For example, each of projection portions 642 of first connector clip 610 is formed by a pair of tabs 644 (as shown at the lowermost protrusion portion 642). Further, the protrusion 643 for a snap-fit connection is provided on the rear tab 644. The pair of tabs 644 of each protrusion portion 642 is configured to provide a friction fit within the recess 678, while the protrusion 642 provides a snap-fit connection in order to hold the first connector clip 610 in place. In some embodiments, both the front tab and rear tab include a protrusion for snap-fit connection. In other embodiments, such as in first connector clip 610, only one of the tabs includes the protrusion.

In certain embodiments of the building surface panel kit as otherwise described herein, the building surface panel kit further includes a second building surface panel having a first end, a second end, a first side, a second side, a front face, and a rear face, the second building surface panel comprising a structural body including a first perimeter wall section at the second end that surrounds a recess configured to receive the second projection of the first connector clip. For example, building surface panel kit 100 may include a second building surface panel having an identical construction as first building surface panel 160 with a recess that is configured to receive the second projection 150 of first connector clip 110. In other embodiments, the first building surface panel and the second building surface panel may have different constructions.

In certain embodiments of the building surface panel kit as otherwise described herein, the base wall is formed by a single plate, and the first projection extends from a first side of the plate and the second projection extends from a second side of the plate. For example, base wall 120 of first connector clip 110 is formed by a single plate. First projection 140 extends from the first side 122 of the single plate of base wall 120 and second projection 150 extends from the second side 124 of the single plate of base wall 120. Such a single plate configuration of the base wall allows for a seamless connection between two building surface panels that are both connected to the connector clip. Visually, the gap between the two building surface panels that are attached to the connector clip is filled by the base wall so as to form a continuous surface from one building surface panel to the next.

Figure 7A:
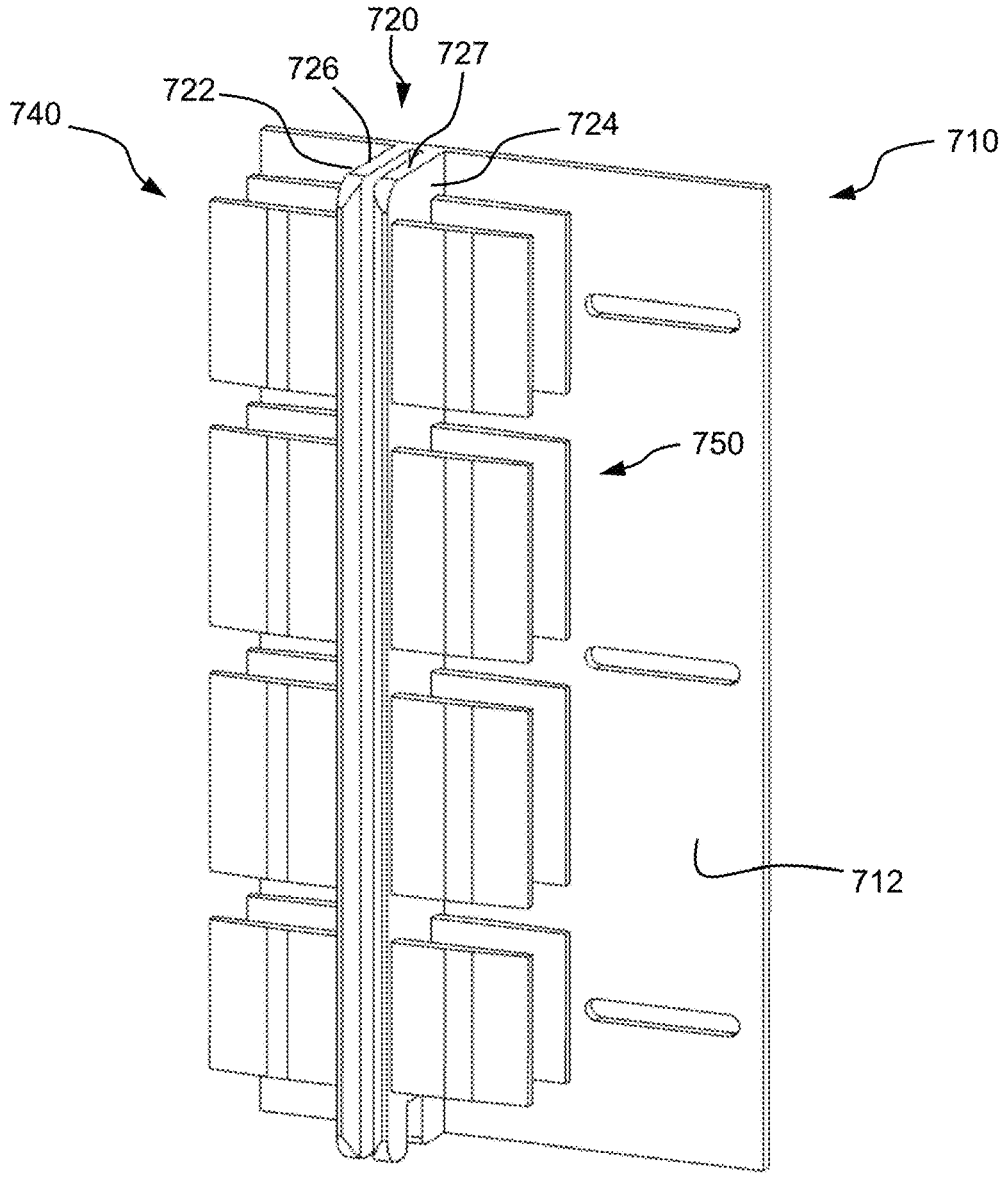
FIG. 7A is a schematic perspective view of a connector clip according to another embodiment of the disclosure.
Figure 7B:
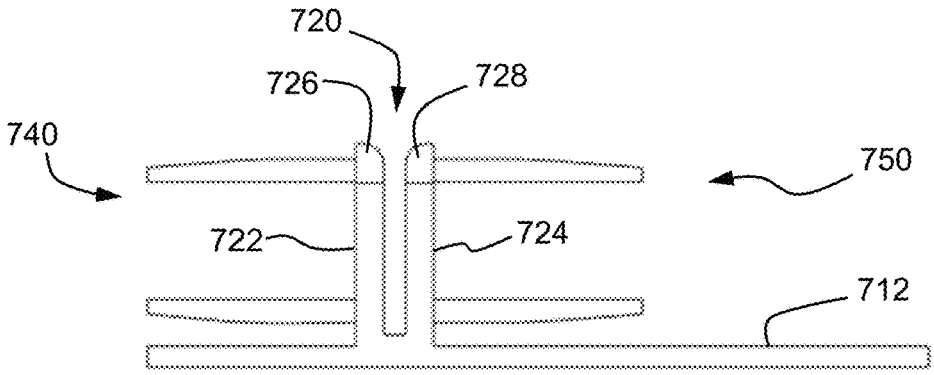
FIG. 7B is a schematic end view of the connector clip of FIG. 7A.

On the other hand, in certain embodiments of the building surface panel kit as otherwise described herein, the base wall includes a first plate and a second plate, and the first projection extends from the first plate and the second projection extends from the second plate. For example, a connector clip including such a configuration is shown in FIGS. 7A and 7B. First connector clip 710 includes a base wall 720 that extends outward from an attachment platform 712. The base wall 720 includes a first plate 726 that forms the first side 722 of the base wall 720 and a second plate 727 that forms the second side 724 of the base wall 720. Each of the first plate 726 and the second plate 727 individually extend from the attachment platform 712 such that base wall 720 is a double-layered wall. Further, first connector clip 710 includes a first projection 740 that extends laterally from first plate 726 at the first side 722 of base wall 720 and a second projection 750 that extends laterally from second plate 727 at the second side 724 of base wall 720 in a direction opposite first projection 740.

Forming the base wall of first and second plates can create a visual of two separated building surface panels, where each building surface panel is capped at its respective end by one of the two plates. However, with the two building surface panels both coupled to the connector clip, the pair of building surface panels will move as unit through their connection by the connector clip. Accordingly, as the building surface panels expand and contract due to changes in temperature, both building surface panels and the connector clip will expand and contract together even though they appear as separate and distinct panels.

In certain embodiments of the building surface panel kit as otherwise described herein, the distance between the first plate and the second plate is adjustable. Accordingly, such a connector clip allows for a variable gap dimension between adjacent building surface panels that are attached to the connector clip.

Figure 8A:
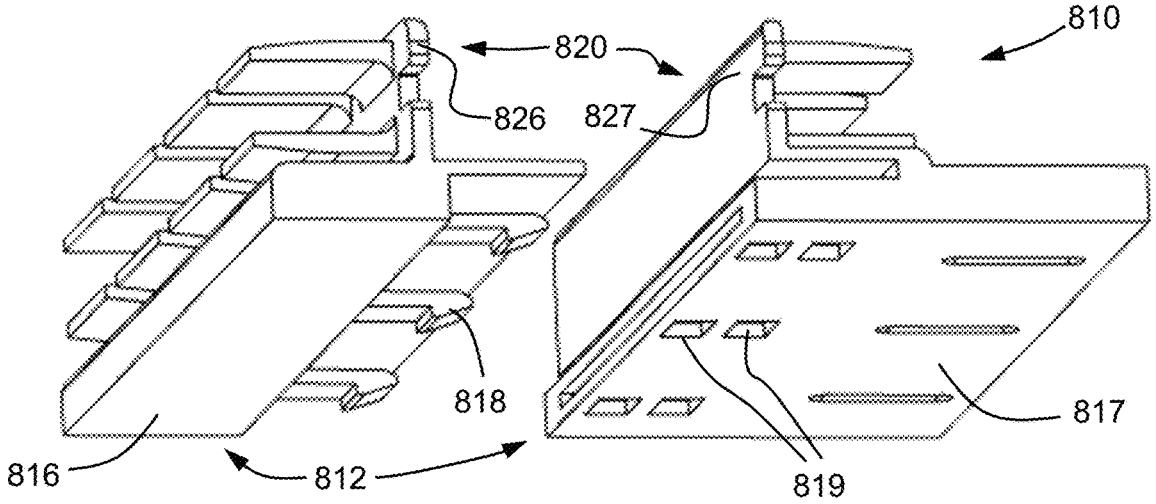
FIG. 8A is a schematic perspective top rear view of a connector clip according to another embodiment of the disclosure in a first position.
Figure 8B:
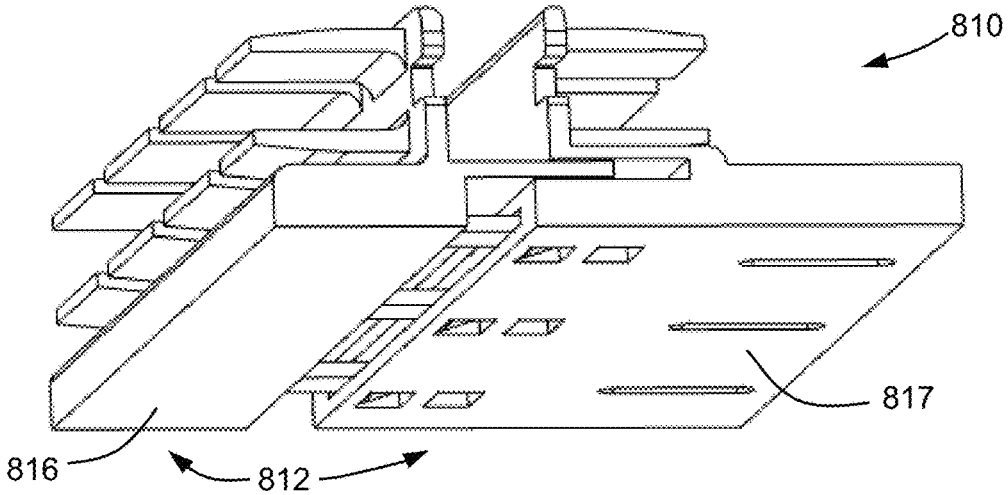
FIG. 8B is a schematic perspective top rear view of the connector clip of FIG. 8A in a second position.
Figure 8C:
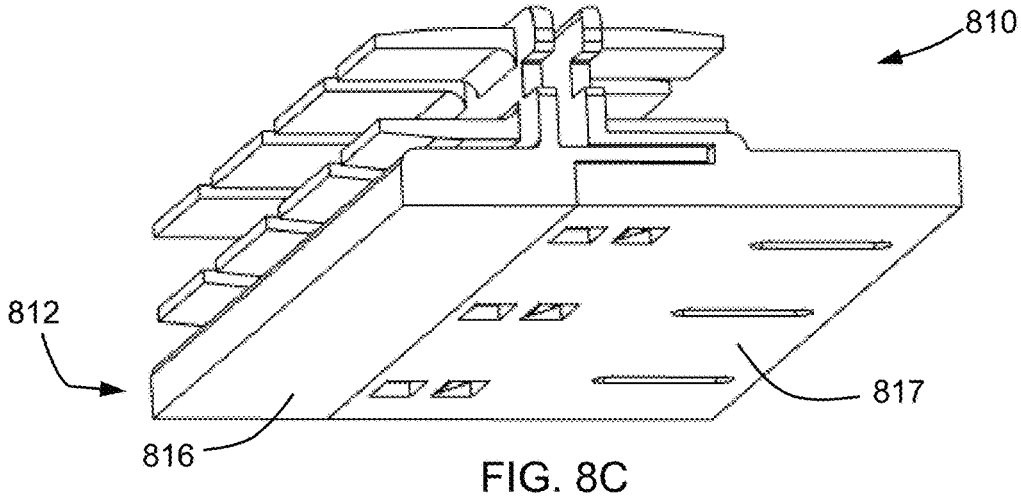
FIG. 8C is a schematic perspective top rear view of the connector clip of FIG. 8A in a third position.

Further, in certain embodiments of the building surface panel kit as otherwise described herein, the attachment platform includes a first portion and a second portion that is connectable to the first portion, the first plate of the base wall is secured to the first portion of the attachment platform, the second plate of the base wall is secured to the second portion of the attachment platform, and the first portion and the second portion of the attachment platform are connectable in a plurality of positions. For example, a connector clip including such a configuration is shown in FIGS. 8A-8C. First connector clip 810 includes an attachment platform 812 comprising a first portion 816 and a second portion 817 that are connectable to one another. Further, base wall 820 includes a first plate 826 and a second plate 827. First plate 826 extends outward from first portion 816 of attachment platform 812 and second plate 827 extends outward from second portion 817 of attachment platform 812. First portion 816 and second portion 817 of attachment platform 812 may be secured to one another using the hooks 818 on the first portion 816 and the receiving holes 819. In particular, as shown in FIGS. 8B and 8C, the hooks 818 of first portion 816 are insertable into the receiving slots/holes 819 of second portion 817. The use of two sets of receiving holes, as shown, allows the first portion 816 and second portion 817 to be connected in two positions. In other embodiments, the first and second portions are connectable in more than two positions, or in one position.

In certain embodiments of the building surface panel kit as otherwise described herein, the first connector clip is an end connector clip, and wherein a second side of the base wall that is opposite the first side is substantially flat. For example, in some embodiments, the connector clip includes a projection extending from one side of the base wall and no projection extending from the other side of the base wall. Such a connector clip is operable to hold the end of a single building surface panel securely to the support structure.

In certain embodiments of the building surface panel kit as otherwise described herein, the building surface panel kit further includes a plurality of additional building surface panels and a plurality of additional connector clips configured to secure the building surface panels to one another and to the support structure. For example, in some embodiments, the building surface panel kit includes building surface panels and connector clips sufficient to cover a large portion of a support structure, such as an exterior wall. In some embodiments, the building surface panel kit includes joint connector clips as well as end connector clips. Further, in some embodiments, the building surface panel kit includes connector clips with a base wall having a single plate and other connector clips with a base wall having first and second plates.

In some embodiments the first connector clip is made of a polymer material. For example, in some embodiments, the first connector clip is made of PVC or ABS. In other embodiments, the first connector clip is made of another polymer material. Still, in other embodiments, the first connector clip is made of metal, or another material. Further, in some embodiments, the first connector clip is made of more than one material. For example, in some embodiments, one portion of the first connector clip is made of a polymer material and another portion is made from metal.

In some embodiments, the first connector clip is cast or molded. In other embodiments, the first connector clip is machined or welded. Further, in some embodiments, the first connector clip is made by an additive manufacturing process, such as 3D printing. Thus, in some embodiments, the first connector clip is formed as a single unitary piece. In other embodiments, the first connector clip is made in separate pieces that are connected to one another. For example, in some embodiments the base wall and projections are formed as one piece that is attached to the support platform, as described in more detail above.

In some embodiments, the first building surface panel has a length that is at least 4 feet, e.g., at least 6 feet, e.g., at least 8 feet. Further, in some embodiments, the first building surface panel has a length no greater than 20 feet, e.g., no greater than 15 feet, e.g., no greater than 12 feet. For example, in some embodiments, the first building surface panel has a length in a range from 4 feet to 20 feet, e.g., from 6 feet to 15 feet, e.g., from 8 feet to 12 feet. In some embodiments, the first building surface panel has a width that is at least 4 inches, e.g., at least 6 inches, e.g., at least 8 inches. Further, in some embodiments, the first building surface panel has a width no greater than 24 inches, e.g., no greater than 18 inches, e.g., no greater than 12 inches. For example, in some embodiments, the first building surface panel has a width in a range from 4 inches to 24 inches, e.g., from 6 inches to 18 inches, e.g., from 8 inches to 12 inches. Further, in some embodiments the first building surface panel has a thickness that is at least ¼ inch, e.g., at least ½ inch feet, e.g., at least 1 inch. Further, in some embodiments, the first building surface panel has a thickness no greater than 4 inches, e.g., no greater than 2% inches, e.g., no greater than 2 inches. For example, in some embodiments, the first building surface panel has a thickness in a range from ¼ inch to 4 inches, e.g., from % inch to 2% inches, e.g., from 1 inch to 2 inches.

Figure 9:
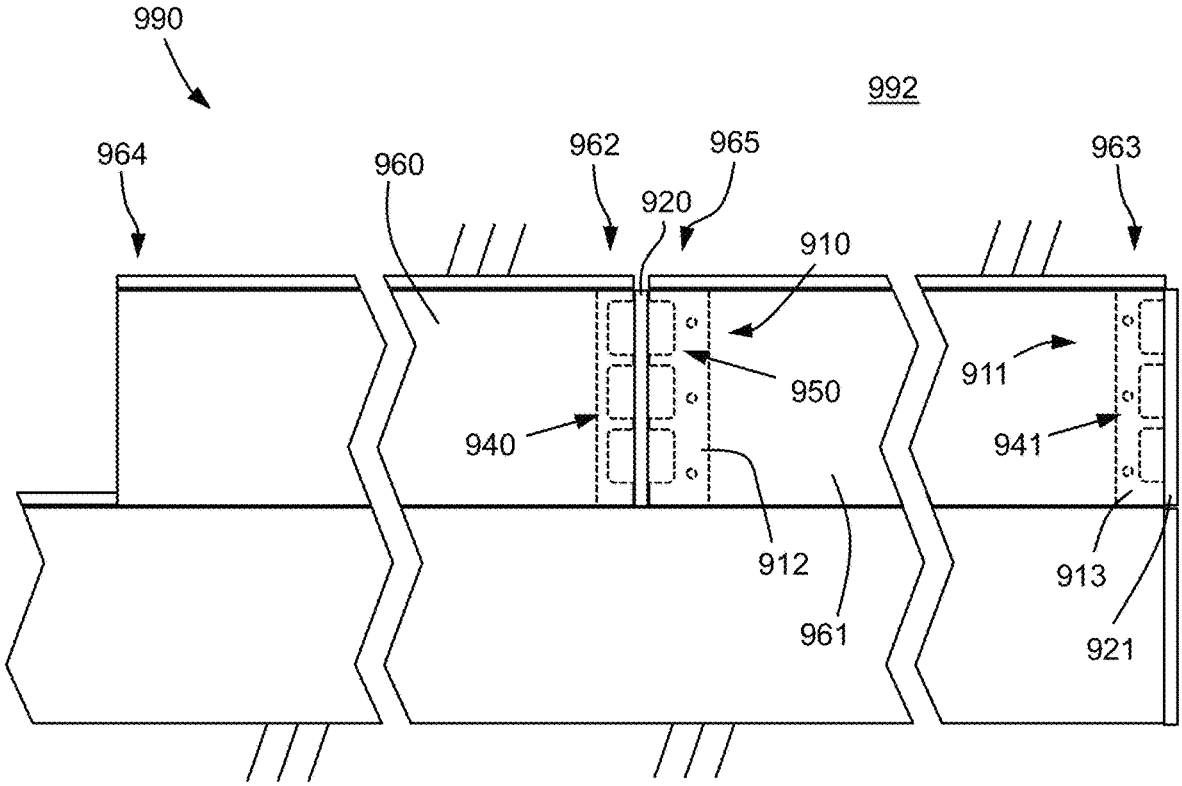
FIG. 9 is a schematic plan view of a building surface panel system according to an embodiment of the disclosure.

In another aspect, the disclosure provides a building surface panel system including a support structure and a building surface panel kit according the disclosure secured to the support structure. The attachment platform of the first connector clip is attached to a surface of the support structure and the first projection of the first connector clip is disposed in the recess at the first end of the first building surface panel. Such a building surface panel system is shown in FIG. 9. Building surface panel system 990 includes a first connector clip 910 secured to a support structure 992 and a first building surface panel 960 that includes a first end 962 and a second end 964. The connector clip 910 is secured to support structure 992 via an attachment platform 912. First connector clip 910 includes a base wall 920 that extends from the attachment platform 912. A first projection 940 extends laterally from base wall 920 and is inserted into a recess at the first end 962 of a building surface panel 960. Accordingly, first connector clip 910 securely holds building surface panel 960 against support structure 992.

In certain embodiments of the building surface panel system as otherwise described herein, the building surface panel system further includes a second building surface panel having a first end, a second end, a first side, a second side, a front face, and a rear face, the second building surface panel comprising a structural body including a perimeter wall including a first perimeter wall section at the first end that surrounds a first recess and a second perimeter wall section at the second end that surrounds a second recess, the first connector clip includes a second projection extending laterally from the base wall in a second direction that is opposite the first direction, and the second projection of the first connector clip is disposed in the second recess at the second end of the second building surface panel. For example, building surface panel system 990 includes a second building surface panel 961 that has the same construction as first building surface panel 960 and includes a first end 963 and a second end 965. Further, first connector clip 910 includes a second projection 950 that extends laterally from base wall 920 in a direction that is opposite first projection 940. The second projection 950 is inserted into a recess surrounded by a perimeter wall section at second end 965 of second building surface panel 961. Accordingly, first building surface panel 960 and second building surface panel 961 are connected to each other by way of first connector clip 910.

In certain embodiments of the building surface panel system as otherwise described herein, the building surface panel system further includes a second connector clip including an attachment platform secured to the support structure, a base wall secured to the attachment platform, and a first projection extending laterally from a first side of the base wall, where the first projection of the second connector clip is disposed in the first recess at the first end of the second building surface panel. For example, building surface panel system 990 also includes a second connector clip 911 that includes an attachment platform 913 secured to the support structure 992. The second connector clip 911 includes a base wall 921 that extends outward from the attachment platform 913 and a first projection 941 that extends laterally from base wall 921. Further first projection 941 of second connector clip 911 is inserted into a recess at the first end 963 of second building surface panel 961 so as to hold the second building surface panel 961 to the support structure 992.

In certain embodiments of the building surface panel system as otherwise described herein, the second connector clip is an end connector clip, and a second side of the base wall of the second connector clip is substantially flat. For example, second connector clip 911 of building surface panel system 990 is an end connector clip and the side of base wall 921 that is opposite first projection 941 is substantially flat. Moreover, the side of base wall 921 that is opposite first projection 941 does not include a projection extending therefrom.

Figure 10:
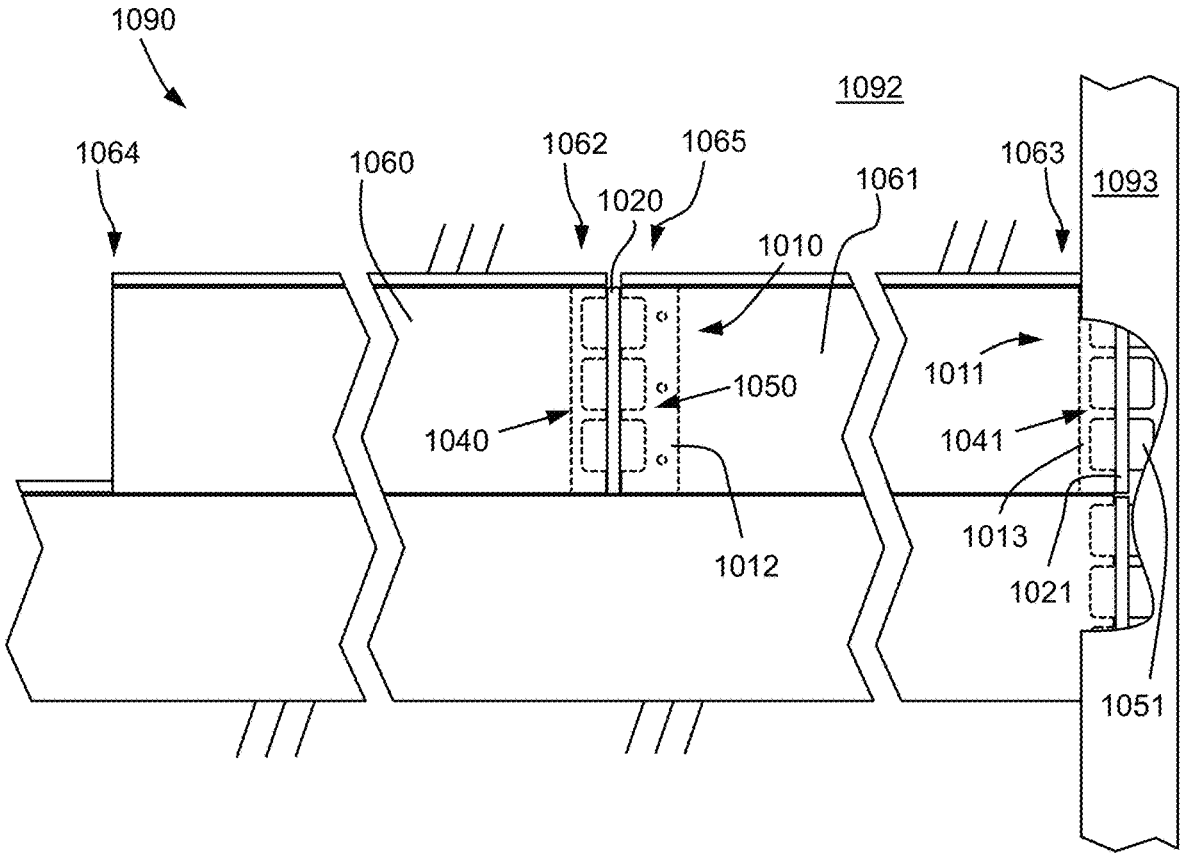
FIG. 10 is a schematic plan view of a building surface panel system according to another embodiment of the disclosure.

In certain embodiments of the building surface panel system as otherwise described herein, a trim element covers the second connector clip. Such a building surface panel system is shown in FIG. 10. Building surface panel system 1090 includes a first connector clip 1010 secured to a support structure 1092 and a first building surface panel 1060 that includes a first end 1062 and a second end 1064. The connector clip 1010 is secured to support structure 1092 via an attachment platform 1012. A first projection 1040 extends laterally from base wall 1020 and is inserted into a recess at the first end 1062 of a first building surface panel 1060. Building surface panel system 1090 also includes a second building surface panel 1061 that has the same construction as first building surface panel 1060 and includes a first end 1063 and a second end 1065. Further, first connector clip 1010 includes a second projection 1050 that extends laterally from base wall 1020 in a direction that is opposite first projection 1040. The second projection 1050 is inserted into a recess surrounded by a perimeter wall section at second end 1065 of second building surface panel 1061. Building surface panel system 1090 also includes a second connector clip 1011 that includes an attachment platform 1013 secured to the support structure 1092. The second connector clip 1011 includes a base wall 1021 that extends outward from the attachment platform 1013 and a first projection 1041 that extends laterally from base wall 1021. The first projection 1041 of second connector clip 1011 is inserted into a recess at the first end 1063 of second building surface panel 1061 so as to hold the second building surface panel 1061 to the support structure 1092. The second connector clip 1011 is covered by a trim element 1093, such as a snap-on lineal, that goes over the connector clip 1011 and the end of the second building surface panel 1061.

In certain embodiments of the building surface panel system as otherwise described herein, the second connector clip is a joint connector clip and includes a second projection extending laterally from a second side of the base wall in a direction opposite the first projection. For example, second connector clip 1011 is a joint connector clip and includes a second projection 1051 extending from base wall 1021 in a direction that is opposite first projection 1041. In building surface panel system 1090, the second projection 1051 of second connector clip 1011 is not being used to secure a building surface panel to the support structure, and instead is simply covered by trim element 1093. However, in other embodiments, the second projection of the second connector clip may be used to secure another building surface panel to the support structure.

Figure 11:
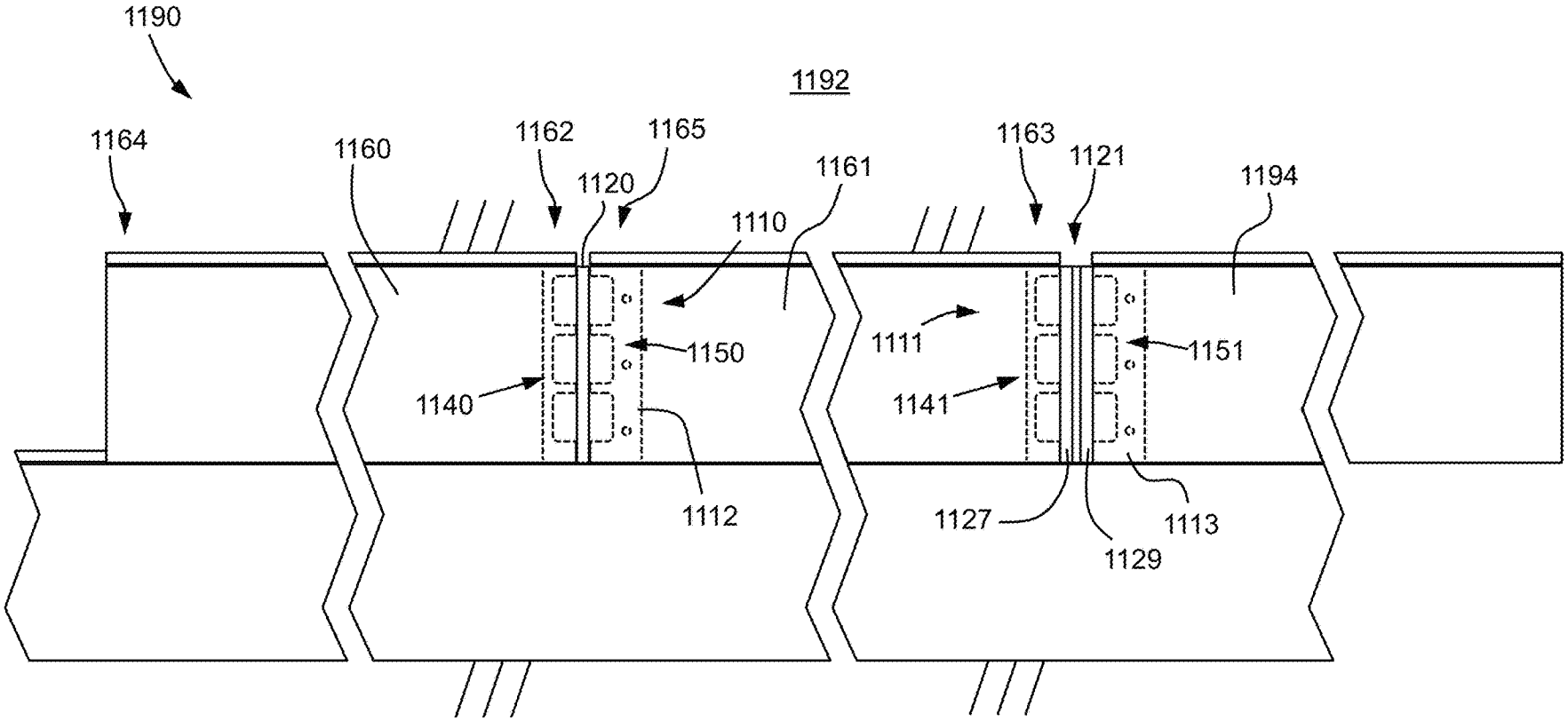
FIG. 11 is a schematic plan view of a building surface panel system according to yet another embodiment of the disclosure.

For example, in certain embodiments of the building surface panel system as otherwise described herein, the building surface panel system further includes a third building surface panel, where the second projection of the second connector clip is disposed in a recess in the third building surface panel. Such a building surface panel system is shown in FIG. 11. Building surface panel system 1190 includes a first connector clip 1110 secured to a support structure 1192 and a first building surface panel 1160 that includes a first end 1162 and a second end 1164. The connector clip 1110 is secured to support structure 1192 via an attachment platform 1112. A first projection 1140 extends laterally from base wall 1120 and is inserted into a recess at the first end 1162 of a first building surface panel 1160. Building surface panel system 1190 also includes a second building surface panel 1161 that has the same construction as first building surface panel 1160 and includes a first end 1163 and a second end 1165. Further, first connector clip 1110 includes a second projection 1150 that extends laterally from base wall 1120 in a direction that is opposite first projection 1140. The second projection 1150 is inserted into a recess surrounded by a perimeter wall section at second end 1165 of second building surface panel 1161.

Building surface panel system 1190 also includes a second connector clip 1111 that includes an attachment platform 1113 secured to the support structure 1192. The second connector clip 1111 includes a base wall 1121 that extends outward from the attachment platform 1113 and a first projection 1141 that extends laterally from base wall 1121. The first projection 1141 of second connector clip 1111 is inserted into a recess at the first end 1163 of second building surface panel 1161 so as to hold the second building surface panel 1161 to the support structure 1192. The second connector clip 1111 also includes a second projection 1151 that extends laterally outward from base wall 1121 in a direction that is opposite first projection 1141. The second projection 1151 is inserted into a recess at the second end of a third building surface panel 1194. Accordingly, the second connector clip 1111 also secures third building surface panel 1194 to support structure 1192.

In certain embodiments of the building surface panel system as otherwise described herein, the base wall of the first connector clip is formed by a single plate with the first projection of the first connector clip extending from a first side of the single plate and the second projection of the first connector clip extending from a second side of the single plate, and the base wall of the second connector clip includes a first plate and a second plate with the first projection of the second connector clip extending from the first plate and the second projection of the second connector clip extending from the second plate. For example, base wall 1120 of first connector clip 1110 includes a single plate and the first projection 1140 and second projection 1150 extend from opposite sides of the single plate of base wall 1120. On the other hand, base wall 1121 of second connector clip 1111 includes a first plate 1127 and a second plate 1129. First projection 1141 extends laterally outward from first plate 1127 and second projection 1151 extends laterally outward from second plate 1129. Accordingly, first connector 1110 provides a seamless visual where a continuous surface extends from first building surface panel 1160 to second building surface panel 1161, while second connector clip 1111 provides a separated visual where there is a gap between second building surface panel 1161 and third building surface panel 1194. Despite the different visuals provided by the two connector clips, all three building surface panels can move as a unit due to their attachment through the two connector clips. In particular, if the attachment apertures are slotted, the first building surface panel 1160, second building surface panel 1161 and third building surface panel 1194 can expand and contract together as a unit.

In another aspect, the disclosure provides another building surface panel kit for attachment to a support structure. The building surface panel kit includes a first building surface panel having a first end, a second end, a front face, a rear face, a first edge including a groove, and a second edge including a tongue configured to be inserted into the groove of another building surface panel. The building surface panel kit also includes a first attachment clip configured to secure the first building surface panel to the support structure. The first attachment clip includes a clip body and an attachment surface coupled to the clip body, where the attachment surface is configured to be secured to the support structure. Further, the attachment clip also includes a retaining fastener coupled to the clip body that is configured to engage an edge of the first building surface panel.

Figure 12:
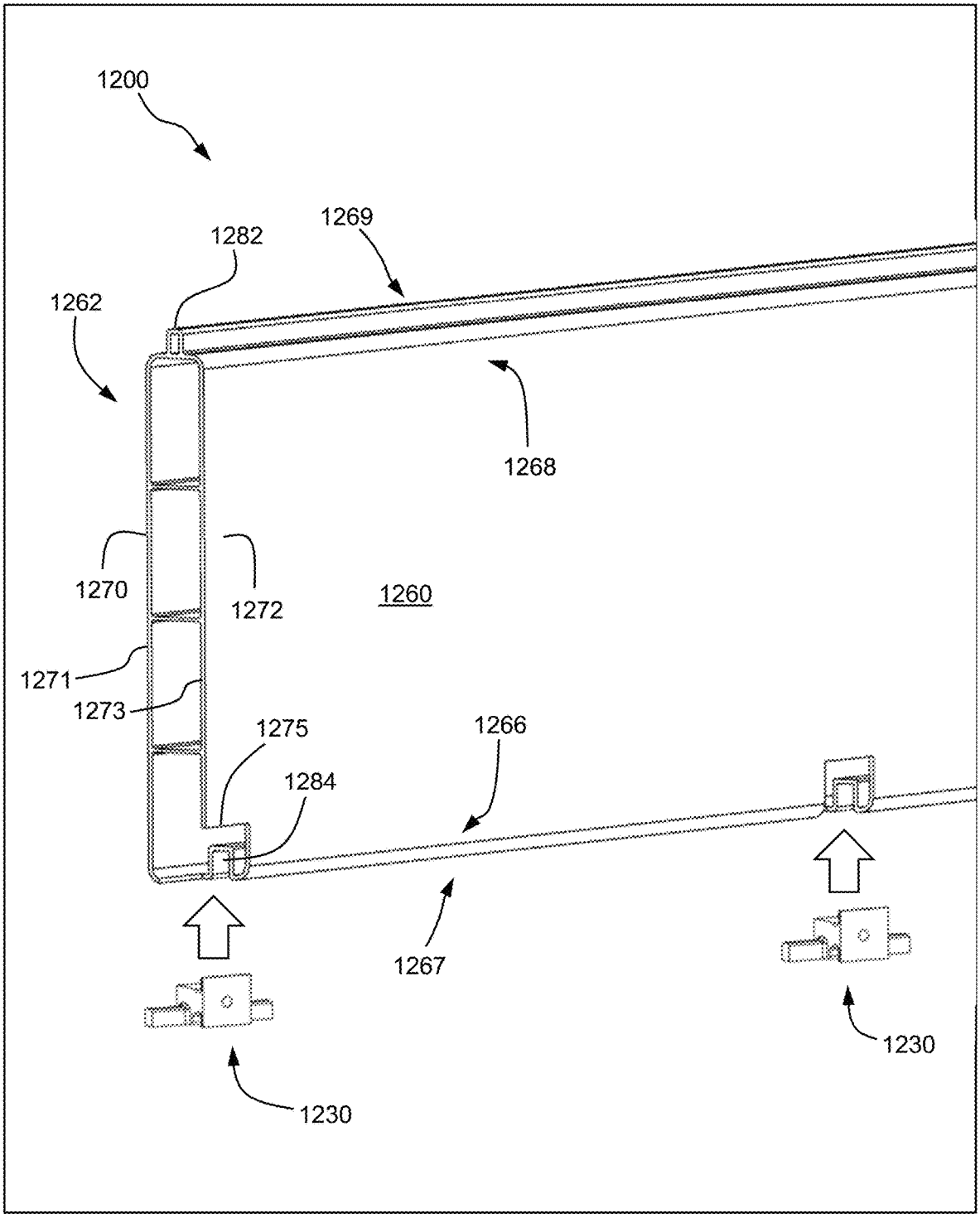
FIG. 12 is a schematic perspective view of elements of a building surface panel kit according to another embodiment of the disclosure.

A rear perspective view of a portion of such a building surface panel kit is shown in FIG. 12. Building surface panel kit 1200 includes a first building surface panel 1260 and a first attachment clip 1230 that is configured to secure first building surface panel 1260 to a support structure. First building surface panel 1260 has two ends including a first end 1262 and a second end that is outside the frame of FIG. 12. First building surface panel 1260 also has a first side 1266, a second side 1268, a front face 1270 and a rear face 1272. In the illustrated configuration, first side 1266 is located at the bottom of first building surface panel 1260 and second side 1268 is located at the top of first building surface panel 1260. However, the orientation of building surface panel 1260 may be flipped, such that first side 1266 is located at the top.

First building surface panel 1260 further includes a first edge 1267 disposed along first side 1266 that includes a groove 1284 extending laterally outward in the direction of the width of building surface panel 1260. Likewise, first building surface panel 1260 also includes a second edge 1269 along second side 1268 that includes a corresponding tongue 1282. Tongue 1282 of second edge 1269 is configured to fit within groove 1284 of first edge 1267, such that a respective tongue and groove of two similar building surface panels may engage one another.

Figure 13:
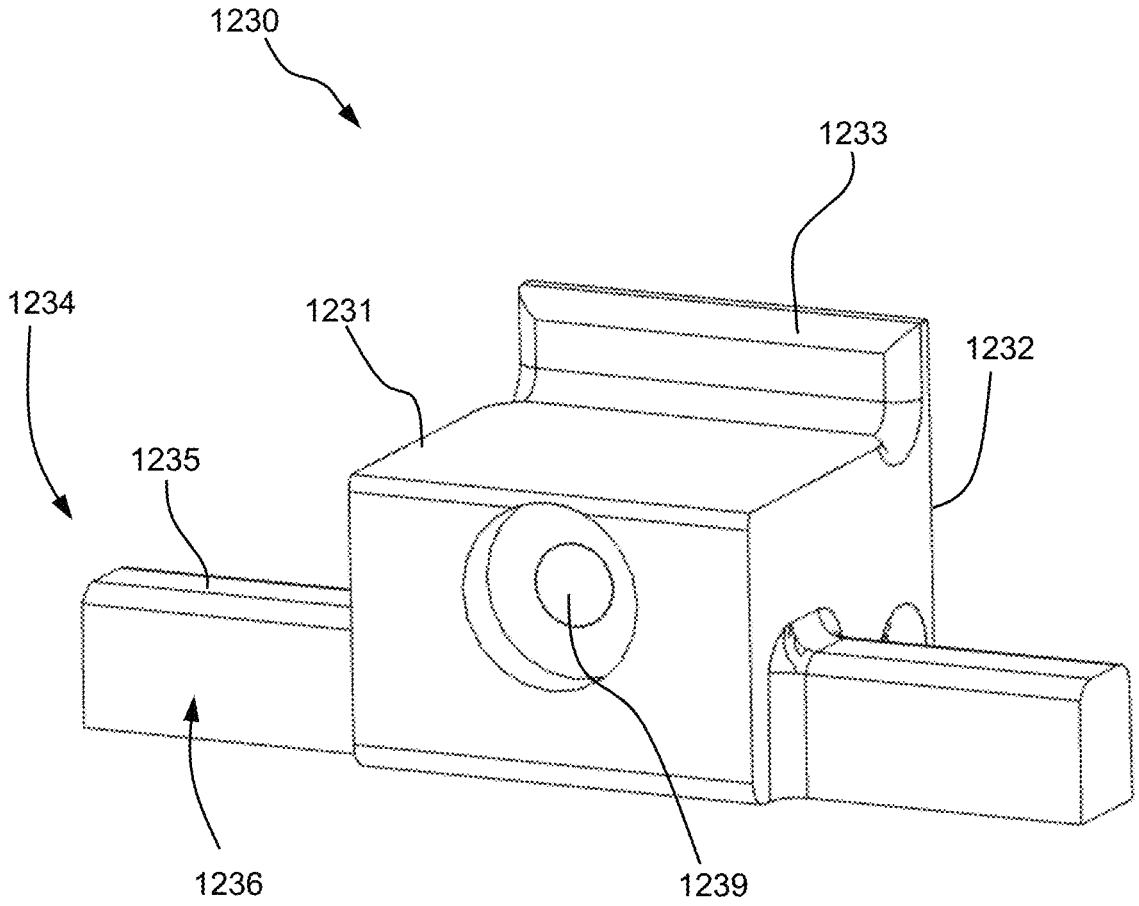
FIG. 13 is a schematic detailed view of an attachment clip of the building surface panel kit of FIG. 12.

Building surface panel kit 1200 also includes an attachment clip 1230 that is configured to secure first building surface panel 1260 to a support structure. A detailed view of attachment clip 1230 is shown in FIG. 13. Attachment clip 1230 includes a clip body 1231 and an attachment surface 1232 secured to clip body 1231. Attachment surface 1232 is positioned on the rear side of clip body 1231 and has a flat configuration in order to engage with a similarly flat surface of the support structure. Further, attachment clip 1230 also includes a retaining fastener 1234 coupled to clip body 1231 that is configured to engage second edge 1269 of first building surface panel 1260. As explained in more detail below, in other embodiments, the retaining fastener is configured to engage the first edge of the first building surface panel.

In certain embodiments of the building surface panel kit as otherwise described herein, the retaining fastener of the first attachment clip includes a ridge configured to engage the groove of the first edge of the first building surface panel. The ridge of the retaining fastener is configured for insertion into the groove such that the ridge is surrounded on three sides by the groove. Such a configuration allows the ridge to provide vertical support of the first building surface panel and to also retain the first building surface panel against any support structure on which the attachment clip is secured. Moreover, the use of a ridge in the retaining fastener allows for lateral movement of the first building surface panel with respect to the attachment clip. Thus, the ridge can move within the groove along the length of the first building surface panel, for example if the first building surface panel expands or contracts.

Attachment clip 1230 includes an embodiment of such a ridge construction. Specifically, retaining fastener 1234 of attachment clip 1230 includes a ridge 1235 that is configured to engage with groove 1284 that extends along first edge 1267. In operation, ridge 1235 extends into groove 1284 such that ridge 1235 is surrounded on three sides by the structure that forms groove 1284. Accordingly, ridge 1235 can provide vertical support and retain first building surface panel 1260 against any support structure on which attachment clip 1230 is secured. Ridge 1235 also allows for lateral movement of first building surface panel 1260 with respect to attachment clip 1230.

In certain embodiments of the building surface panel kit as otherwise described herein, the ridge is disposed on an arm that extends laterally from the clip body. For example, ridge 1235 of retaining fastener 1234 in attachment clip 1230 is disposed on an arm 1236 that extends laterally outward from clip body 1231. Arm 1236 extends in the same direction as first building surface panel 1260 and ridge 1234 runs along the top surface of arm 1236. In some embodiments, the arm is configured to fit within the groove of the first building surface panel along with the ridge. For example, arm 1236 is configured so that both ridge 1235 and arm 1236 are inserted into groove 1284. In other embodiments, the ridge extends outward from the arm and only the ridge fits within the groove of the first building surface panel. For example, in some embodiments, the arm is wider than the groove and the narrower ridge extends upward from the arm so as to be insertable into the groove. In other embodiments the arm is tall and only the upper section of the arm, where the ridge is formed, fits into the groove.

In some embodiments, the retaining fastener includes two arms that extend laterally from the clip body in opposite direction. For example, retaining fastener 1234 of attachment clip 1230 includes two arms that extend in opposite directions from clip body 1231. In other embodiments, the retaining fastener includes only a single arm. Still in other embodiments, the retaining fastener does not include any arms. For example, in some embodiments, the ridge of the retaining fastener is disposed on a top surface of the clip body and is insertable into the groove of the first building surface panel without the use of an arm.

In certain embodiments of the building surface panel kit as otherwise described herein, the retaining fastener of the first attachment clip includes a notch configured to receive the tongue of the first edge of the first building surface panel. The notch of the retaining fastener is configured to receive the tongue such that the front and rear surfaces of the tongue are held by the notch, which allows the notch to retain the first building surface panel against the support structure without hindering lateral movement of the building surface panel. For example, the tongue can move through the notch along the length of the first building surface panel as the first building surface panel expands or contracts.

Figure 14:
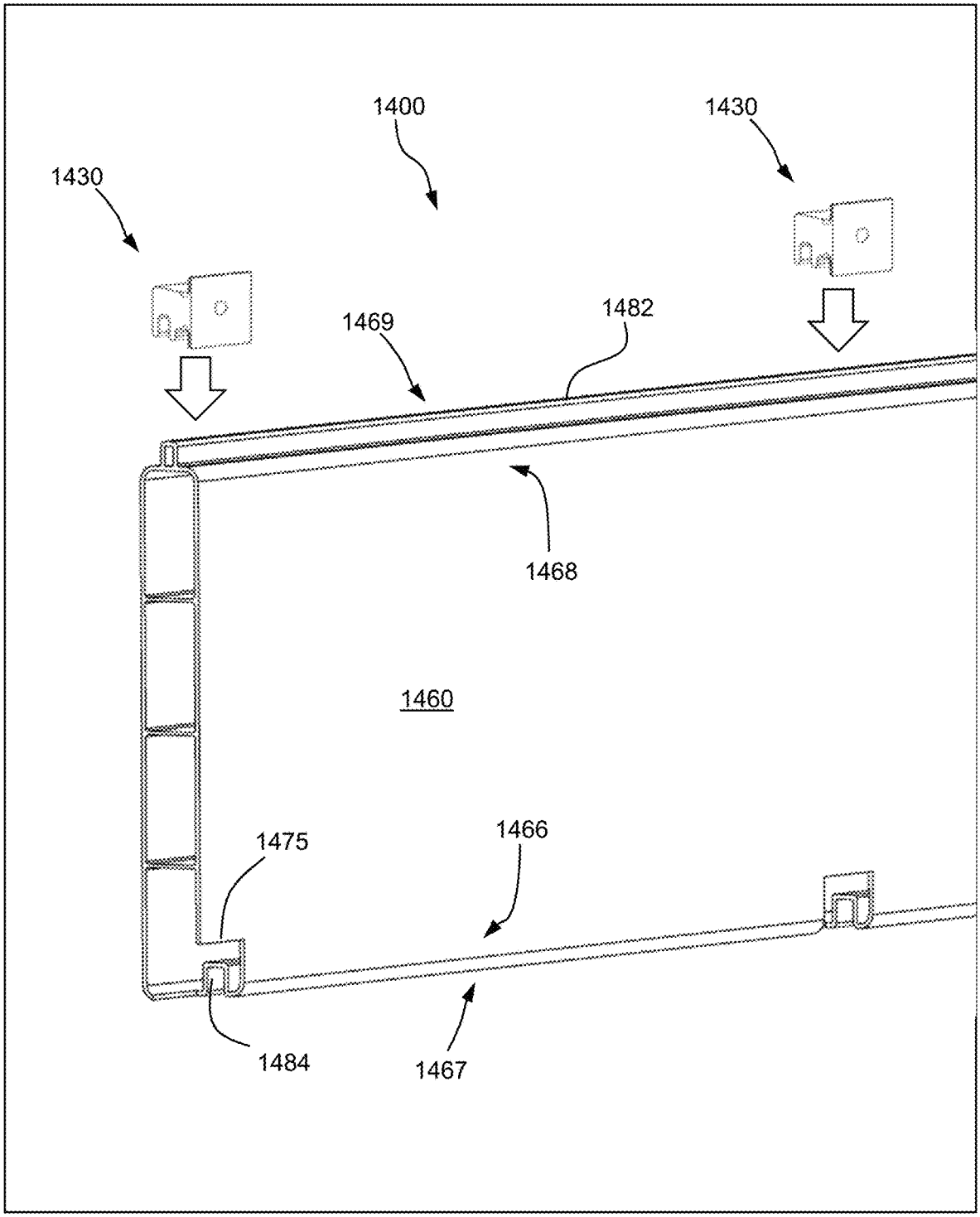
FIG. 14 is a schematic perspective view of elements of a building surface panel kit according to another embodiment of the disclosure.
Figure 15:
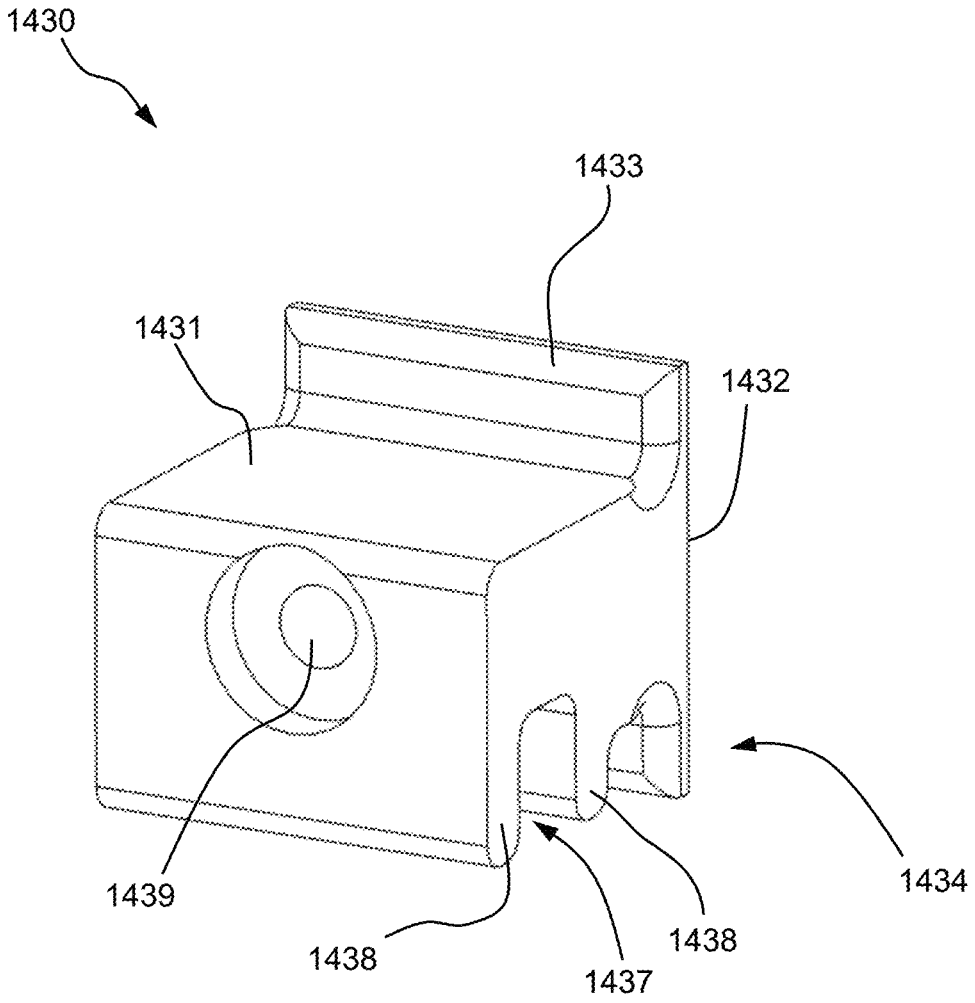
FIG. 15 is a schematic detailed view of an attachment clip of the building surface panel kit of FIG. 14.

A rear perspective view of a portion of an embodiment of a building surface panel kit including such a first attachment clip is shown in FIG. 14. Building surface panel kit 1400 includes a first building surface panel 1460 and a first attachment clip 1430 that is configured to secure first building surface panel 1460 to a support structure. First building surface panel 1460 has a first edge 1467 disposed along a first side 1466 that includes a groove 1484, and a second edge 1469 disposed along a second side 1468 that includes a tongue 1482. Building surface panel kit 1400 also includes an attachment clip 1430 that is configured to secure first building surface panel 1460 to a support structure. A detailed view of attachment clip 1430 is shown in FIG. 15. Attachment clip 1430 includes a clip body 1431 and an attachment surface 1432 secured to clip body 1431 that is configured to engage a support structure. Further, attachment clip 1430 also includes a retaining fastener 1434 coupled to clip body 1431 that is in the form of a notch 1437. Notch 1437 is configured to engage second edge 1469 along second side 1468. In particular, notch 1437 is configured to receive tongue 1482 that extends along second edge 1469.

In certain embodiments of the building surface panel kit as otherwise described herein, the notch is formed between two retaining walls that extend from the clip body. For example, notch 1437 is bordered by two retaining walls 1438 which form the structure of notch 1437 therebetween. Retaining walls 1438 are position to the front and to the rear of notch 1437 and are configured to engage tongue 1482 so as to retain first building surface panel 1460 against the support structure. In particular, the retaining wall 1438 positioned in front of notch 1437 prevents first building surface panel 1460 from being separated from the support structure.

In certain embodiments of the building surface panel kit as otherwise described herein, the clip body includes an aperture configured to receive a mechanical fastener for fastening the retaining clip to the support structure. To secure the attachment clip to the support structure, the mechanical fastener extends through the aperture and into the support structure where it is securely held in place. In some embodiments the aperture is a bore for receiving a nail or screw. For example, as shown in FIG. 13, clip body 1231 of attachment clip 1230 includes an aperture 1239 in the form of a bore that extends through the middle of clip body 1231. Similarly, attachment clip 1430, as shown in FIG. 15, includes an aperture 1439 that extends through the middle of clip body 1431. In other embodiments, the aperture is configured as a slot or has another shape.

In certain embodiments of the building surface panel kit as otherwise described herein, the aperture extends from a front face of the clip body to the attachment surface. For example, as shown in FIG. 13, aperture 1239 of attachment clip 1230 extends through the middle of clip body 1231 from a front surface of the clip body 1231 through the attachment surface 1232. Likewise, as shown in FIG. 15, aperture 1439 of attachment clip 1430 extends through clip body 1431 from a front surface to the attachment surface 1432.

Further, in some embodiments, the attachment clip does not include any aperture. For example, in some embodiments, the attachment clip is configured to be secured to the support structure by a mechanical fastener that penetrates through a section of the attachment clip. For example, in some embodiments, the attachment clip is configured to receive a nail or screw that is driven through the clip body. In other embodiments, the attachment clip is configured to be secured to the support structure using a mechanical fastener that surrounds a portion of the attachment clip. For example, in some embodiments, the clip body includes one or more tabs that are configured to be secured to the support structure using a staple.

Further still, in some embodiments the attachment clip is configured to be secured to the support structure without the use of a mechanical fastener. For example, in some embodiments the attachment clip includes a layer of adhesive on the attachment surface for attaching the attachment clip to the support structure. Of course, such an adhesive layer may also be used in combination with a mechanical fastener.

In certain embodiments of the building surface panel kit as otherwise described herein, the attachment clip further includes a foot attached to the clip body, and wherein the attachment surface is disposed on the foot. In some embodiments, the foot extends outward from the clip body. Such a foot provides an enlarged area for the attachment surface, which enhances the attachment of the attachment clip to an underlying support structure. For example, as shown in FIG. 13, attachment clip 1230 includes a foot 1233 coupled to the rear side of clip body 1231. Foot 1233 extends outward from clip body 1231 and includes attachment surface 1232 thereon. Accordingly, attachment surface 1232 has a larger area than the cross section of clip body 1231. Attachment clip 1430, as shown in FIG. 15, has a similar configuration and includes a foot 1433 coupled to the clip body 1431 that provides the attachment surface 1432. On the other hand, in some embodiments, the attachment clip does not include a foot. For example, in some embodiments, the attachment surface is disposed directly on a rear surface of the clip body.

In various embodiments of the building surface panel kit, the first building surface panel includes any combination of the building surface panel features described above. For example, in some embodiments the first building surface panel includes a hollow structural body where a front wall forms the front face of the building surface panel and a rear wall forms the rear face of the building surface panel. For example, building surface panel 1260, as shown in FIG. 12, includes a hollow structural body that includes a front wall 1271 that forms the front face 1270 and a rear wall 1273 that forms the rear face 1272.

In certain embodiments of the building surface panel kit as otherwise described herein, the hollow structural body of the first building surface panel is an extruded member. For example, in some embodiments, the first building surface panel is extruded from a die and has a substantially uniform cross section along an entire length of the panel. For example, first building surface panel 1260 has a substantially uniform cross section along the length thereof such that the front wall 1271, rear wall 1273, tongue 1282 and groove 1284 extend along the length of the first building surface panel.

In certain embodiments of the building surface panel kit as otherwise described herein, the rear wall of the hollow structural body includes an opening to accommodate the first attachment clip. For example, in first building surface panel 1260, the rear wall 1273 includes an opening 1275 that is configured to accommodate first attachment clip 1230. In particular, opening 1275 is positioned such that clip body 1231 of first attachment clip 1230 can be placed within opening 1275 when the ridge 1235 on arm 1236 engages with groove 1284 of the first building surface panel 1260.

In certain embodiments of the building surface panel kit as otherwise described herein, the opening is adjacent to the first edge. For example, opening 1275 in building surface panel 1260 is positioned at the first edge 1267 next to groove 1284. Such a position allows attachment clip 1230, which includes laterally extending arms 1236 that form ridges 1235, to be aligned with groove 1284. Accordingly, the arms 1236 can extend laterally into the groove 1284. Likewise, opening 1475 in building surface panel 1460 is also positioned at the first edge 1467 next to groove 1484. Thus, if attachment clip 1430 is disposed within the opening 1475, i.e., at the bottom of building surface panel 1460, the notch 1437 will be aligned with groove 1484. As a result, the notch 1437 and groove 1484 form a continuing channel to receive the tongue 1482 of a neighboring building surface panel.

In certain embodiments of the building surface panel kit as otherwise described herein, a gap is formed in the groove at the opening. For example, first building surface panel 1260 includes a gap in groove 1284 that extends the width of opening 1275. Such a gap may be formed by removing a portion of the groove along with a portion of the rear wall when the opening is formed. For example, the first building surface panel may be cut to remove a portion of the rear wall and a portion of the groove so as to form the opening and gap simultaneously. The gap in the groove can allow the clip body of the attachment clip to sit within the first building surface panel where the groove is absent or has been removed.

In certain embodiments of the building surface panel kit as otherwise described herein, a length of the attachment clip is longer than a length of the opening. For example, attachment clip 1230 is longer with respect to the length direction of first building surface panel 1260 than the opening 1275. In particular, arms 1236 extend outward from clip body 1231 to an extent that is longer than opening 1275. Accordingly, the ends of arms 1236 are able to sit within groove 1284 where the arms 1236 extend beyond opening 1275.

In certain embodiments of the building surface panel kit as otherwise described herein, a length of the attachment clip is shorter than a length of the opening. For example, the length of attachment clip 1430 with respect to the length direction of the first building surface panel 1460, is shorter than the length of opening 1475. Accordingly, clip body 1431 is able to fit entirely within opening 1475 such that there is no interference between the attachment clip 1430 and the first building surface panel 1460 when the first building surface panel 1460 is secured to the support structure.

Figure 16:
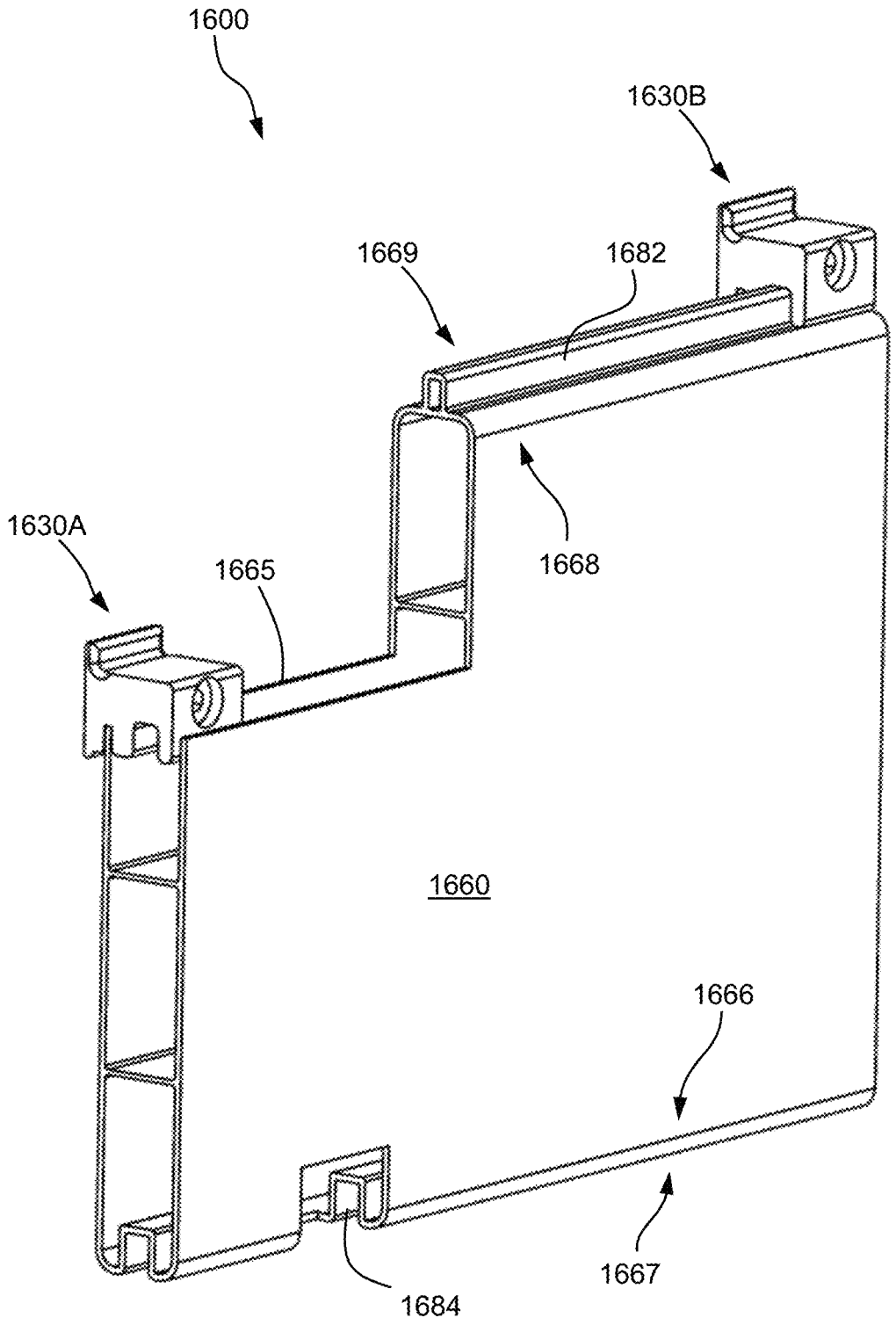
FIG. 16 is a schematic perspective view of elements of a building surface panel kit according to another embodiment of the disclosure.

In certain embodiments of the building surface panel kit as otherwise described herein, the attachment clip further includes a slot configured to engage a cut edge of a building surface panel. A front perspective view of a portion of an embodiment of a building surface panel kit including such a first attachment clip is shown in FIG. 16. Building surface panel kit 1600 includes a first building surface panel 1660 and a first attachment clip 1630A that is configured to secure first building surface panel 1660 to a support structure. First building surface panel 1660 has a first edge 1667 disposed along a first side 1666 that includes a groove 1684, and a second edge 1669 disposed along a second side 1668 that includes a tongue 1682. Further, first building surface panel 1660 also has a cut edge 1665 between the first side 1666 and the second side 1668. Building surface panel kit 1600 also includes an attachment clip 1630A that is configured to secure first building surface panel 1660 to a support structure.

Figure 17:
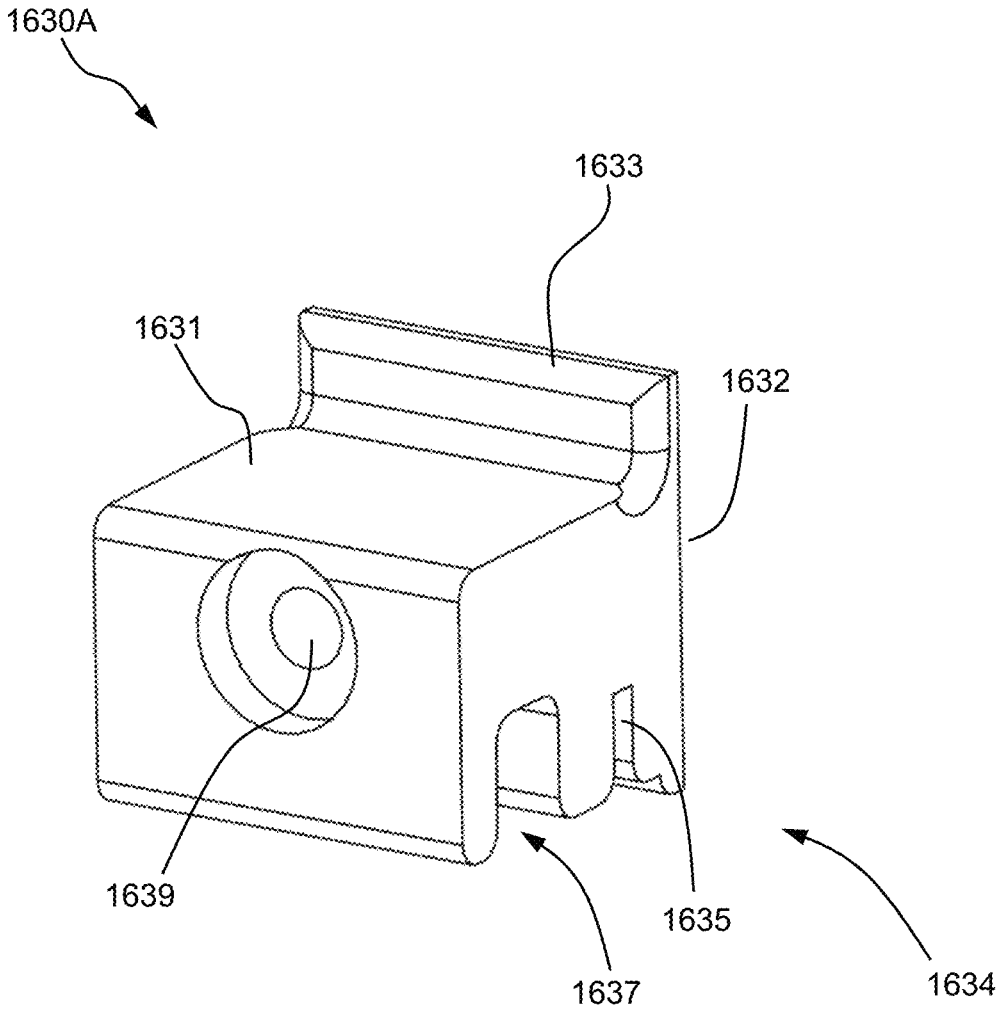
FIG. 17 is a schematic detailed view of an attachment clip of the building surface panel kit of FIG. 16.

A detailed view of attachment clip 1630A is shown in FIG. 17. Attachment clip 1630A includes a clip body 1631 and an attachment surface 1632 secured to clip body 1631 that is configured to engage a support structure. Further, attachment clip 1630A also includes a retaining fastener 1634 coupled to clip body 1631 that is in the form of a notch 1637. Notch 1637 is configured to engage second edge 1669 along second side 1668. In particular, notch 1637 is configured to receive tongue 1682 that extends along second edge 1669. For example, as shown in FIG. 16, attachment clip 1630B, which has an identical construction to attachment clip 1630A, is engaged with second edge 1669 such that the notch in attachment clip 1630B is receiving tongue 1682 of first building surface panel 1660.

Attachment clip 1630A also includes a slot 1635 configured to receive a cut edge of the building surface panel. For example, as shown in FIG. 16, attachment clip 1630A is receiving the cut edge 1665 of building surface panel 1660 within slot 1635. The slot 1635 allows attachment clip 1630A to secure a building surface panel to a support structure if the building surface panel has been cut and the tongue along the first edge of the building surface panel has been removed. Accordingly, if a group of building surface panels are not perfectly sized to fit a desired area of a support structure, one of the building surface panels can be cut to size. The cut edge of this panel may then be secured to the support structure using an attachment clip with a slot, where the cut edge is held in the slot. While attachment clip 1630A includes the slot 1635 with a retaining fastener in the form of a notch 1637, in other embodiments, the slot is included in an attachment clip that uses a ridge as the retaining fastener. Further still, in some embodiments, the building surface panel kit includes one or more attachment clip that has a slot for holding a cut edge of a building surface panel and does not include either retaining fastener.

In certain embodiments of the building surface panel kit as otherwise described herein, the slot configured to receive a cut edge of a building surface panel is disposed between the clip body and the attachment surface. For example, slot 1635 of attachment clip 1630A is positioned between clip body 1631 and attachment surface 1632.

In some embodiments, the cut edge building surface panel includes a front wall and a rear wall and the slot is configured to receive the rear wall of the cut edge of the building surface panel. For example, building surface panel 1660 has a front wall and a rear wall and slot 1635 is secured on the rear wall such that attachment clip 1630A is behind the front surface of building surface panel 1660.

In certain embodiments of the building surface panel kit as otherwise described herein, the first attachment clip is one of a plurality of attachment clips including a first group of attachment clips and a second group of attachment clips, where the retaining fastener of each attachment clip in the first group of attachment clips includes a ridge configured to engage the groove of the first edge of the first building surface panel and the retaining fastener of each attachment clip in the second group of attachment clips includes a notch configured to receive the tongue of the second edge of the first building surface panel.

Figure 18:
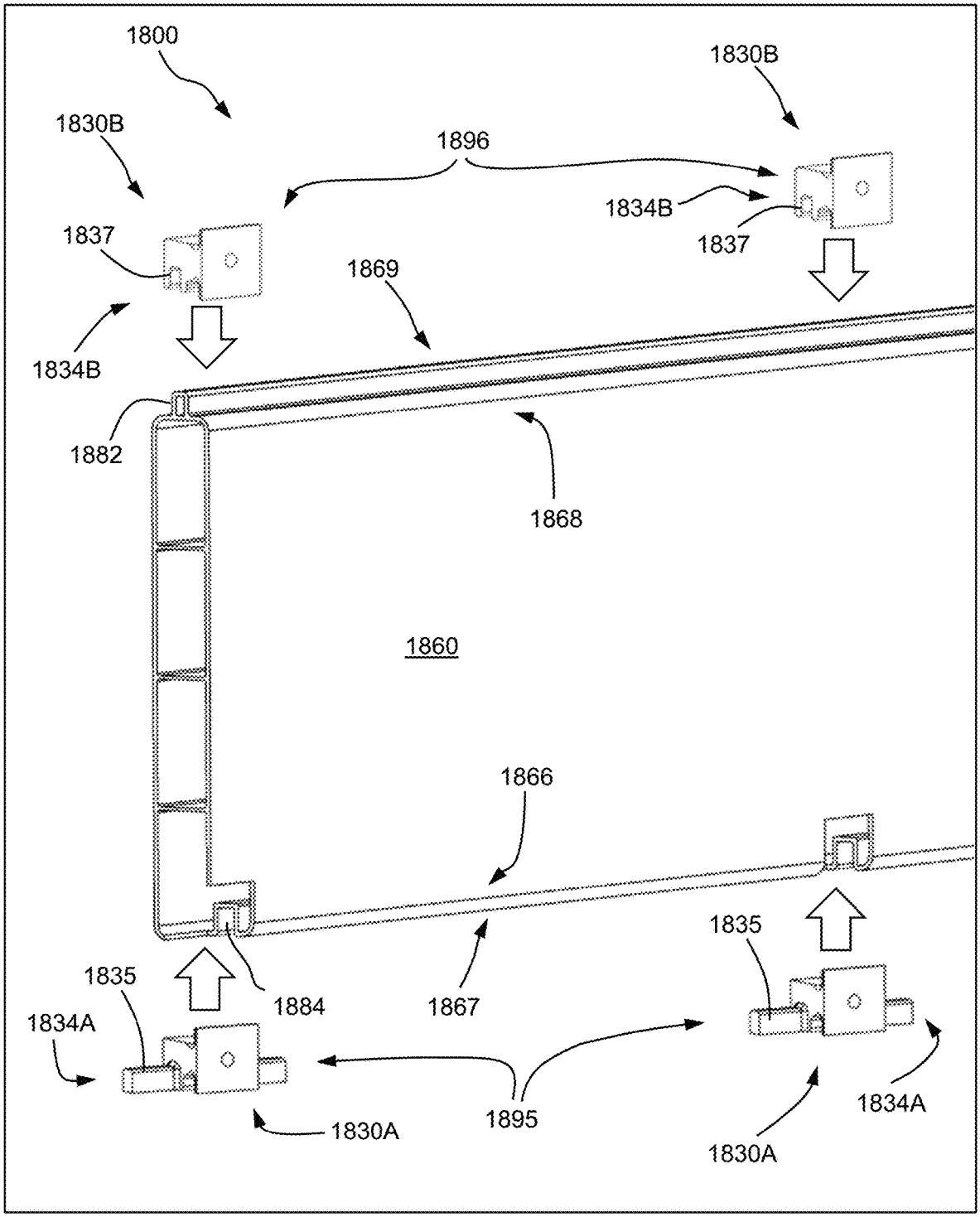
FIG. 18 is a schematic perspective view of elements of a building surface panel kit according to another embodiment of the disclosure.

Such a building surface panel kit is shown in FIG. 18. Building surface panel kit 1800 includes a first building surface panel 1860, a first group 1895 of attachment clips 1830A, and a second group 1896 of attachment clips 1830B. First building surface panel 1860 has a first edge 1867 disposed along a first side 1866 that includes a groove 1884, and a second edge 1869 disposed along a second side 1868 that includes a tongue 1882. Each attachment clip 1830A in the first group 1895 includes a retaining fastener 1834A that has a ridge 1835 configured to engage groove 1884 at the first edge 1867 of building surface panel 1860. On the other hand, each attachment clip 1830B in the second group 1896 includes a retaining fastener 1834B that has a notch 1837 configured to receive tongue 1882 at the second edge 1869 of building surface panel 1860. Accordingly, upon installation of the building surface panel kit on a support structure, the first group 1895 and second group 1896 are configured to engage opposing edges of the building surface panel 1860.

Figure 23:
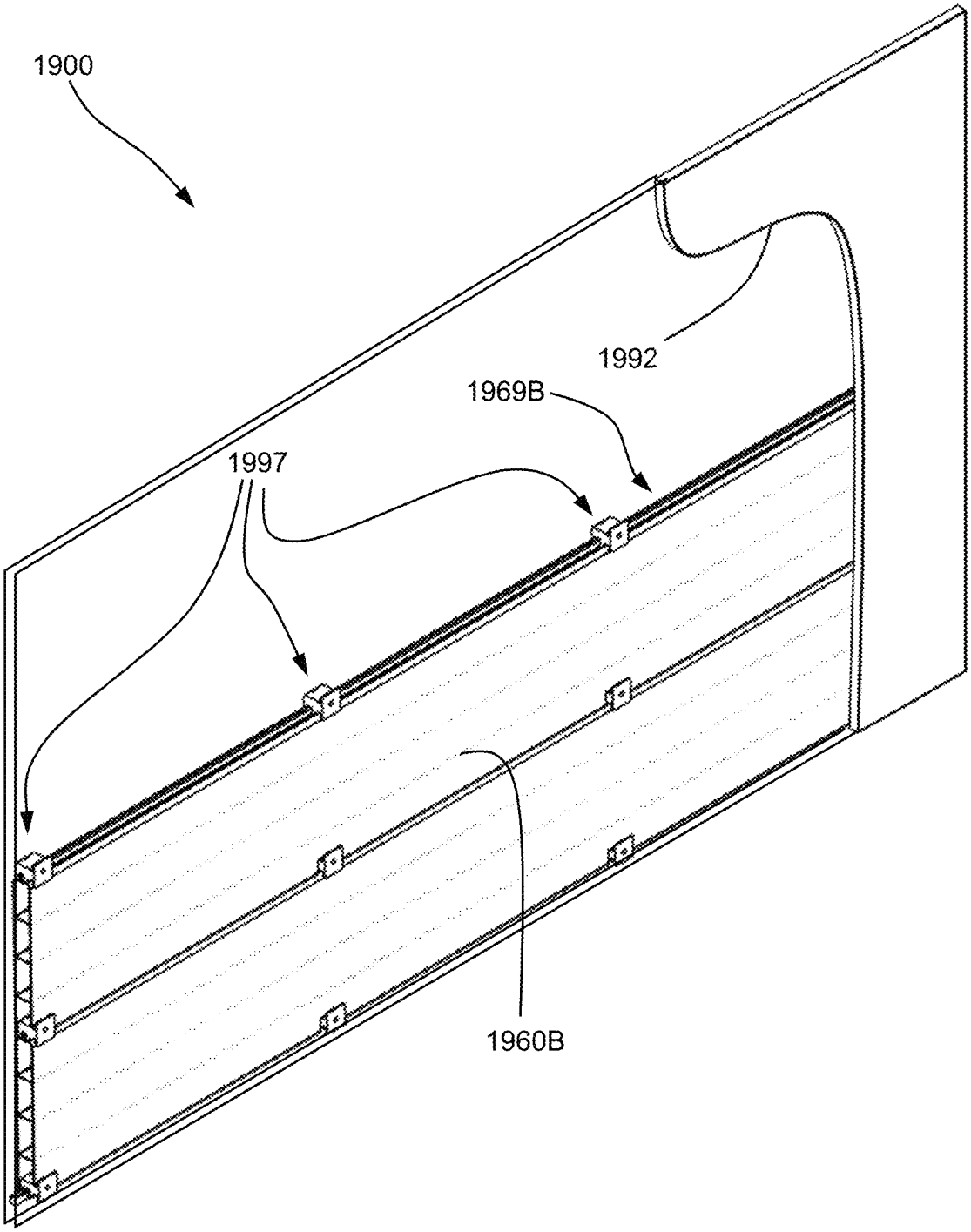
FIG. 23 is a schematic perspective view of another step in the assembly the building surface panel system of FIG. 19.

In certain embodiments of the building surface panel kit as otherwise described herein, the building surface panel kit further includes a plurality of additional building surface panels configured to be secured to a support structure using the plurality of attachment clips. For example, in some embodiments, the building surface panel kit includes another building surface panel that is configured to be placed on top of the first building surface panel. To secure the second building surface panel, the groove of the second building surface panel is configured to receive the tongue of the first building surface panel. Further, additional attachment clips of the first group may be used to secure the second building surface panel to the support structure. An embodiment of a building surface panel kit with multiple building surface panels is shown in FIG. 23 in a configuration where the components of the building surface panel kit are attached to a support structure.

In certain embodiments of the building surface panel kit as otherwise described herein, the building surface panel kit further includes a first connector clip according to the disclosure. For example, in some embodiments, the building surface panel kit includes the above-described attachment clips along with any of the connector clips of the disclosure, such as those connector clips described with reference to FIGS. 1 to 8C. The connector clips are configured to join two building surface panels together at their respective ends, while the attachment clips are configured to secure the building surface panels to the support structure. Further, in some embodiments, the connector clips are also configured to secure the building surface panels to the support structure.

In another aspect, the disclosure provides a method of securing a building surface panel kit according to the disclosure to a support structure. The method includes attaching a first group of attachment clips to a support structure. Each of the attachment clips in the first group of attachment clips has a retaining fastener including a ridge configured to engage a groove of a building surface panel. The method also includes securing a first building surface panel to the first group of attachment clips by placing the ridge of each attachment clip into a groove on a first edge of the first building surface panel. Further, the method includes securing a second group of attachment clips to a second edge of the first building surface panel. Each of the attachment clips in the second group of attachment clips has a retaining fastener including a notch, and the second group of attachment clips are secured to the second edge of the first building surface panel by placing a tongue located on the second edge of the first building surface panel into each notch of a respective attachment clip of the second group of attachment clips. The attachment clips in the second group of attachment clips are then attached to the support structure.

Figure 19:
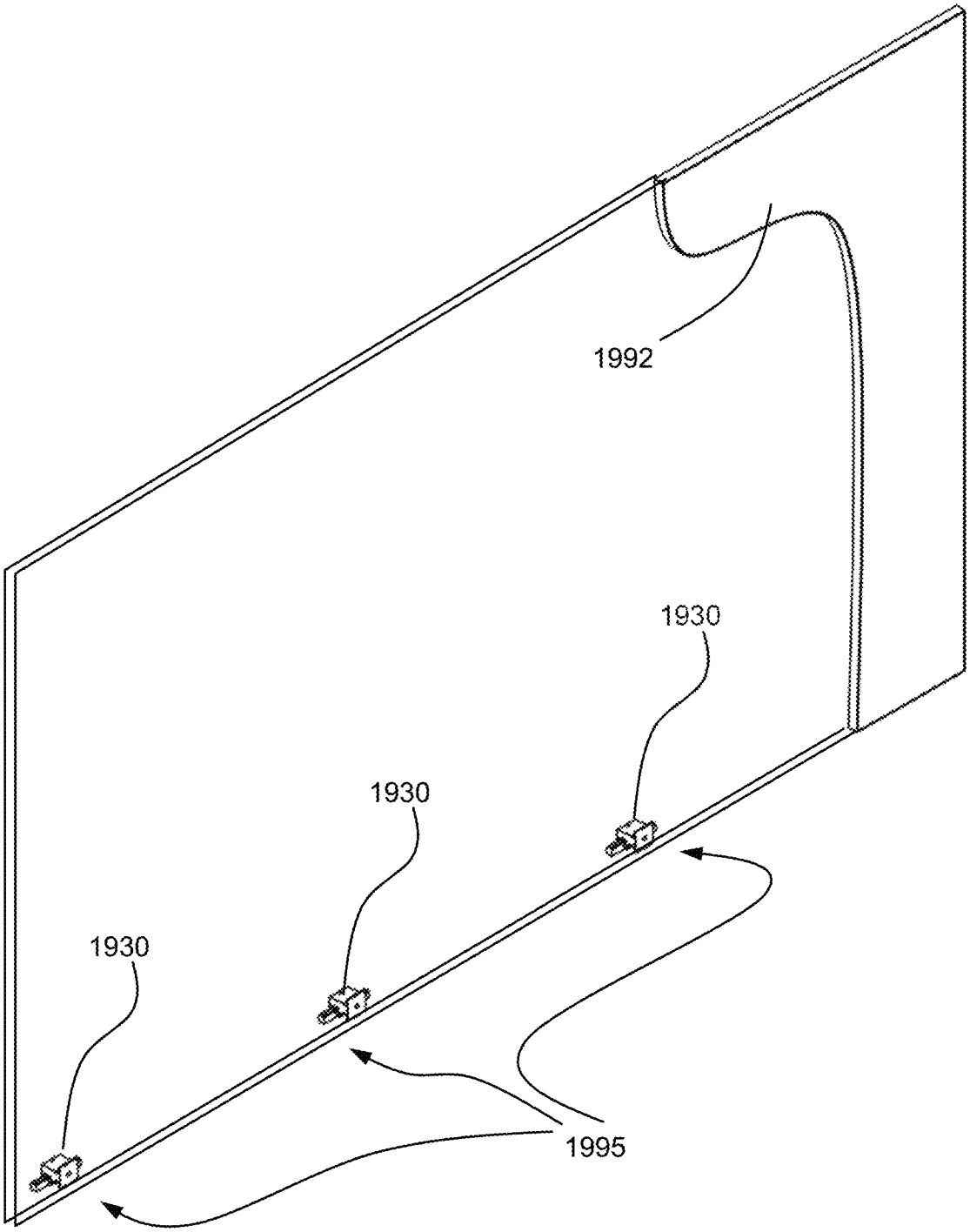
FIG. 19 is a schematic perspective view of a step in the assembly of a building surface panel system according to an embodiment of the disclosure.
Figure 20:
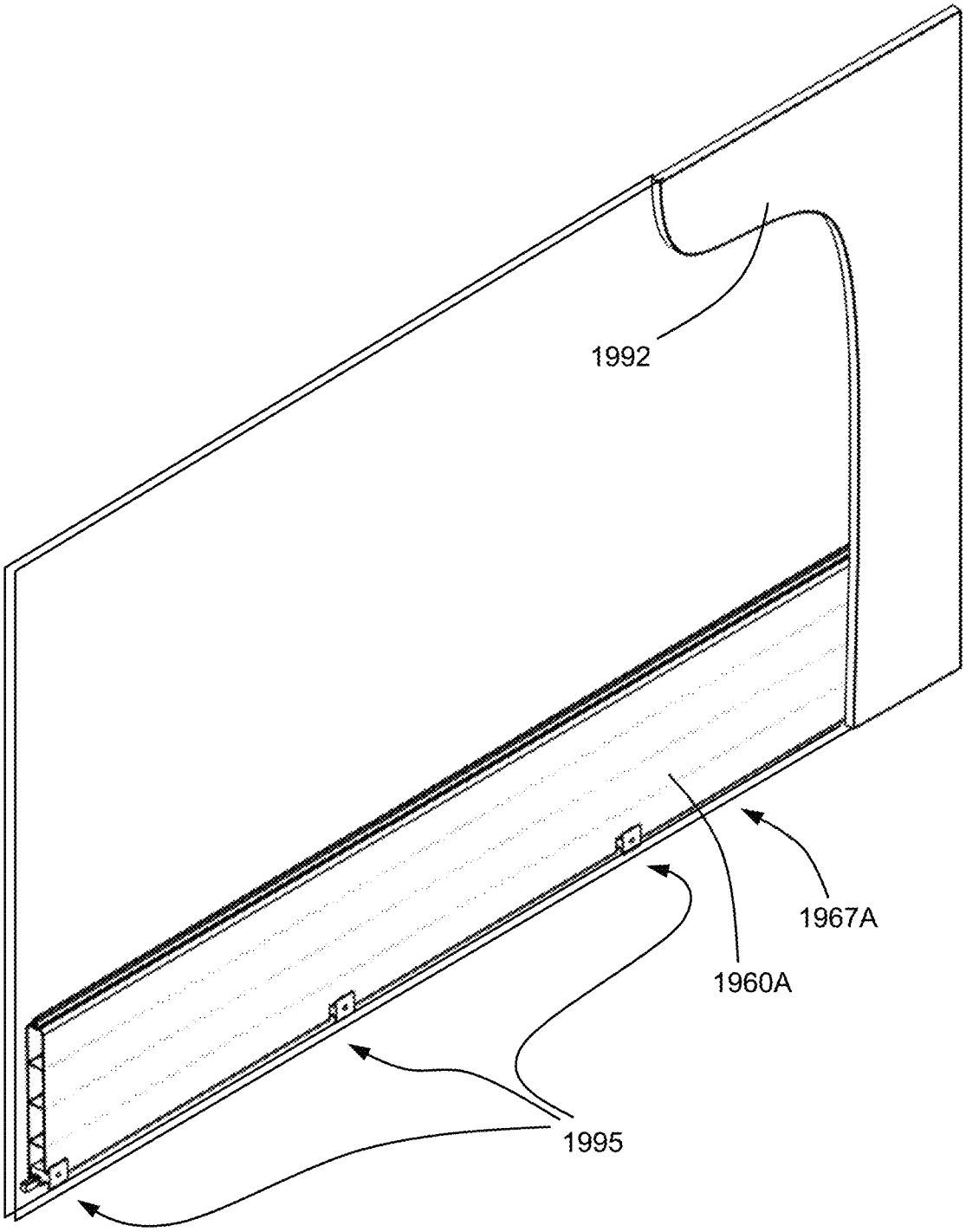
FIG. 20 is a schematic perspective view of another step in the assembly of the building surface panel system of FIG. 19.
Figure 21:
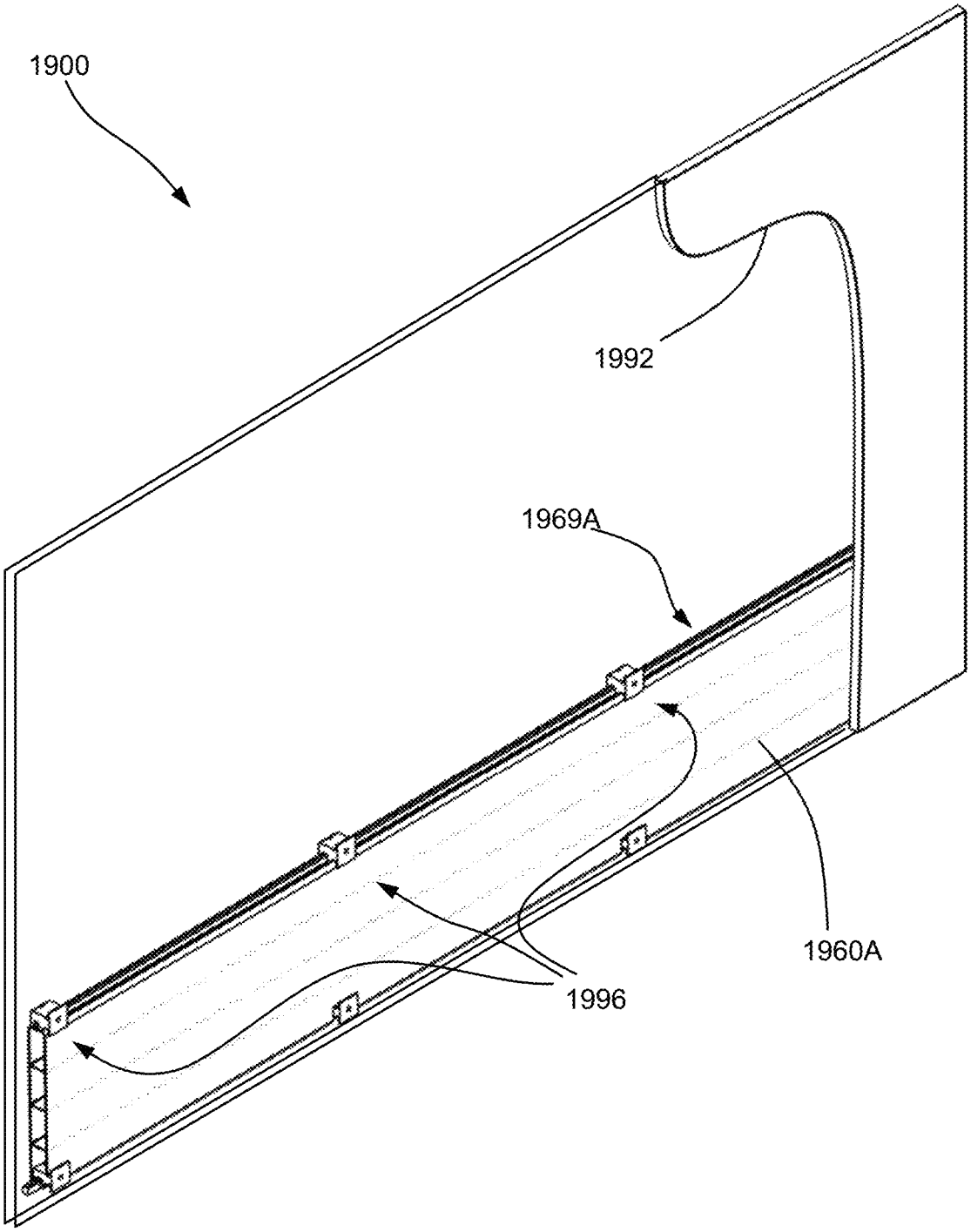
FIG. 21 is a schematic perspective view of another step in the assembly the building surface panel system of FIG. 19.

FIGS. 19-21 show a sequence in an embodiment of such a method. FIG. 19 shows a rear view of a support structure 1992 and a first group of attachment clips 1995 secured to support structure 1992. To illustrate the connection between the attachment clips 1930 described herein and the support structure 1992, much of support structure 1992 is shown as transparent. Each of the attachment clips 1930 in the first group of attachment clips 1995 includes a retaining fastener including a ridge that is configured to engage a groove of a building surface panel. As shown in FIG. 20, the method further includes securing a first building surface panel 1960A to the first group of attachment clips 1995 by placing the ridge of each attachment clip into a groove on a first edge 1967A of the first building surface panel 1960A. Further, as shown in FIG. 21, the method further includes securing a second group of attachment clips 1996 to a second edge 1969A of the first building surface panel 1960A. Each of the attachment clips in the second group of attachment clips 1996 has a retaining fastener including a notch. The attachment clips in the second group of attachment clips 1996 are secured to the second edge 1969A of the first building surface panel 1960A by placing a tongue located on the second edge 1969A of the first building surface panel 1960A into each notch of a respective attachment clip of the second group of attachment clips 1996. The attachment clips in the second group of attachment clips 1996 are then attached to the support structure 1992. With the second group of attachment clips 1996 attached to support structure, the first group of attachment clips 1995, second group of attachment clips 1996, first building surface panel 1960A and support structure 1992 form a building surface panel system 1900.

Figure 22:
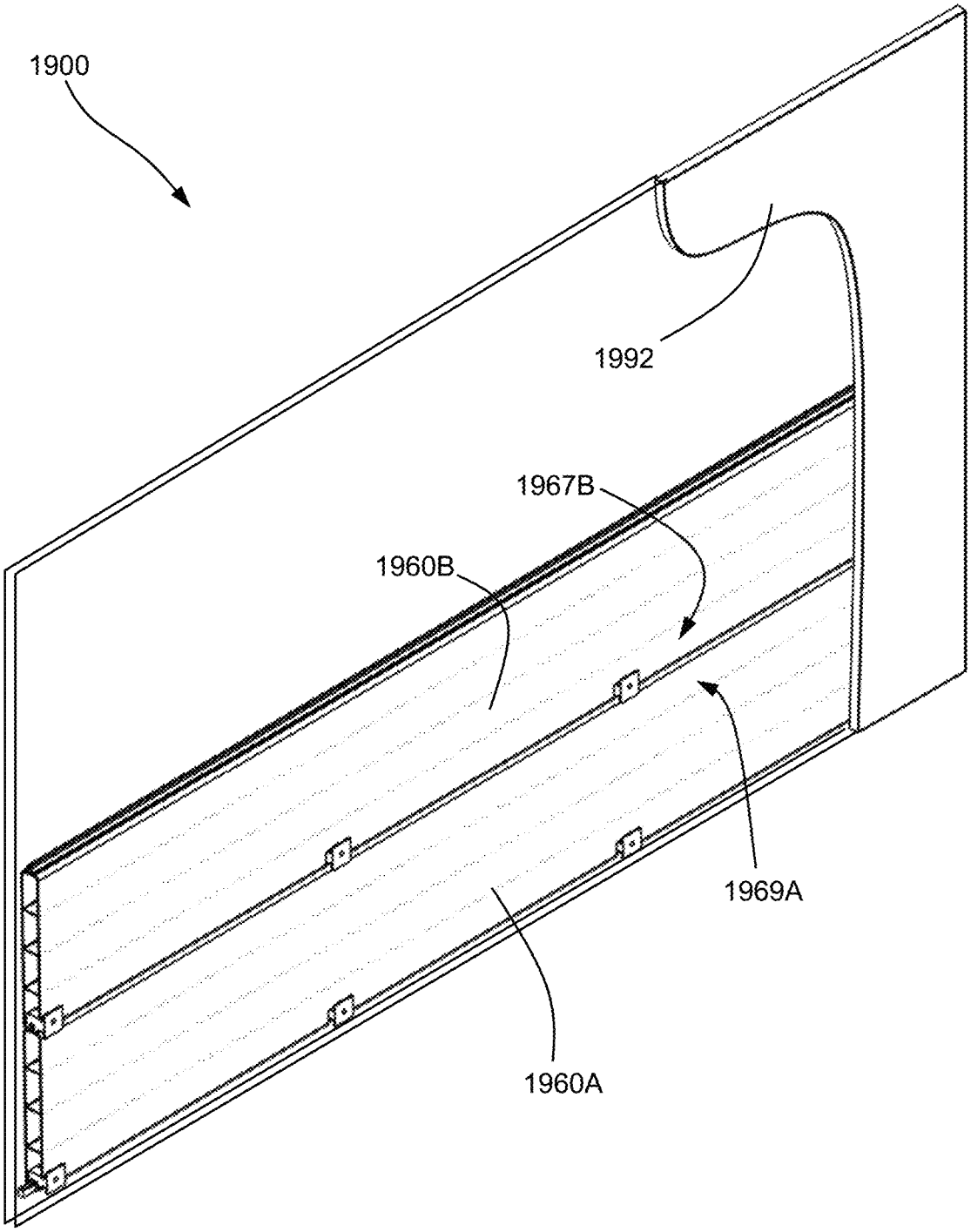
FIG. 22 is a schematic perspective view of another step in the assembly the building surface panel system of FIG. 19.

In certain embodiments of the method as otherwise described herein, the method further includes securing a second building surface panel to the first building surface panel by inserting the tongue located on the second edge of the first building surface panel into a groove on a first edge of the second building surface panel. For example, as shown in FIG. 22, a second building surface panel 1960B is coupled to first building surface panel 1960A by inserting the tongue located on second edge 1969A into a groove located on first edge 1967B of second building surface panel 1960B. Accordingly, second building surface panel 1960B is added to building surface panel system 1900.

In certain embodiments of the method as otherwise described herein, the method further includes securing a third group of attachment clips to a second edge of the second building surface panel. Each of the attachment clips in the third group of attachment clips has a retaining fastener including a notch, and securing the third group of attachment clips to the second edge of the second building surface panel includes placing a tongue located on the second edge of the second building surface panel into each notch of a respective attachment clip of the third group of attachment clips. The third group of attachment clips is then attached to the support structure. For example, as shown in FIG. 23, a third group of attachment clips 1997 is secured to a second edge 1969B of the second building surface panel 1960B. Each of the attachment clips in the third group of attachment clips 1997 has a retaining fastener including a notch, and securing the third group of attachment clips 1997 to the second edge 1969B of the second building surface panel 1960B includes placing a tongue located on the second edge 1969B of the second building surface panel 1960B into each notch of a respective attachment clip of the third group of attachment clips 1997. The attachment clips in the third group of attachment clips 1997 are then attached to the support structure 1992. Accordingly, the third group of attachment clips 1997 is added to the building surface panel system 1900.

In certain embodiments as otherwise described herein, attaching the attachment clips to the support structure includes extending a mechanical fastener through a respective aperture in each of the attachment clips and into the support structure. In other embodiments, the attachment clips are attached using a mechanical fastener that punctures the attachment clips. Still, in other embodiments the attachment clips are attached using an adhesive.

Another aspect of the disclosure is a building surface panel system secured to a support structure, the building surface panel system comprising a first building surface panel secured to the support structure via a first group of attachment clips and a second group of attachment clips. The building surface panel, the first group of attachment clips and the second group of attachment clips, and their association with one another and the support structure can be as described with reference to any of the kits and methods above.

It will be apparent to those skilled in the art that various modifications and variations can be made to the processes and devices described here without departing from the scope of the disclosure. For example, the processes and devices can be oriented in multiple directions such has vertical and horizontal or on multiple surfaces such as walls, floors or ceilings. Such building surface panel kits could be installed on the insides or outsides of buildings or in open air spaces wherein the building surface panel kits when assembled may define the building surface. Thus, it is intended that the present disclosure cover such modifications and variations of this invention provided they come within the scope of the appended claims and their equivalents.

EMBODIMENTS

Embodiment 1. A building surface panel kit for attachment to a support structure, the building surface panel kit comprising:

- a first building surface panel having a first end, a second end, a front face, a rear face, a first edge including a groove, and a second edge including a tongue configured to be inserted into the groove of another building surface panel; and
- a first attachment clip configured to secure the first building surface panel to the support structure, the first attachment clip including:
  - a clip body,
  - an attachment surface coupled to the clip body and configured to be secured to the support structure, and
  - a retaining fastener coupled to the clip body and configured to engage an edge of the first building surface panel.

Embodiment 2. The building surface panel kit according to embodiment 1, wherein the retaining fastener of the first attachment clip includes a ridge configured to engage the groove of the first edge of the first building surface panel.

Embodiment 3. The building surface panel kit according to embodiment 2, wherein the ridge is disposed on an arm that extends laterally from the clip body.

Embodiment 4. The building surface panel kit according to embodiment 1, wherein the retaining fastener of the first attachment clip includes a notch configured to receive the tongue of the second edge of the first building surface panel.

Embodiment 5. The building surface panel kit according to embodiment 4, wherein the notch is formed between two retaining walls that extend from the clip body.

Embodiment 6. The building surface panel kit according to any of embodiments 1 to 5, wherein the clip body includes an aperture configured to receive a mechanical fastener for fastening the retaining clip to the support structure.

Embodiment 7. The building surface panel kit according to embodiment 6, wherein the aperture extends from a front face of the clip body to the attachment surface.

Embodiment 8. The building surface panel kit according to any of embodiments 1 to 7, wherein the attachment clip further includes a foot attached to the clip body, and wherein the attachment surface is disposed on the foot.

Embodiment 9. The building surface panel kit according to embodiment 8, wherein the foot extends outward from the clip body.

Embodiment 10. The building surface panel kit according to any of embodiments 1 to 9, wherein the first building surface panel includes a hollow structural body including a front wall forming the front face and a rear wall forming the rear face.

Embodiment 11. The building surface panel kit according to embodiment 10, wherein the hollow structural body of the first building surface panel is an extruded member.

Embodiment 12. The building surface panel kit according to embodiment 10 or embodiment 11, wherein the rear wall of the hollow structural body includes an opening to accommodate the first attachment clip.

Embodiment 13. The building surface panel kit according to embodiment 12, wherein the opening is adjacent to the first edge.

Embodiment 14. The building surface panel kit according to embodiment 12 or embodiment 13, wherein a gap is formed in the groove at the opening.

Embodiment 15. The building surface panel kit according to any of embodiments 12 to 14, wherein a length of the attachment clip is longer than a length of the opening.

Embodiment 16. The building surface panel kit according to any of embodiments 12 to 14, wherein a length of the attachment clip is shorter than a length of the opening.

Embodiment 17. The building surface panel kit according to any of embodiments 1 to 16, wherein the attachment clip further includes a slot configured to engage a cut edge of a building surface panel.

Embodiment 18. The building surface panel kit according to embodiment 18, wherein the slot is disposed between the clip body and the attachment surface.

Embodiment 19. The building surface panel kit according to any of embodiments 1 to 18, wherein the front face of the first building surface panel includes a textured contour.

Embodiment 20. The building surface panel kit according to embodiment 19, wherein the textured contour replicates a cut wooden plank.

Embodiment 21. The building surface panel kit according to any of embodiments 1 to 20, wherein the rear face of the first building surface panel includes a textured contour.

Embodiment 22. The building surface panel kit according to any of embodiments 1 to 18, wherein each of the front face and the rear face of the first building surface panel includes a textured contour.

Embodiment 23. The building surface panel kit according to any of embodiment 22, wherein the textured contour of the front and rear faces of the first building surface panel are different from each other.

Embodiment 24. The building surface panel kit according to any of embodiments 1 to 23, wherein the first attachment clip is one of a plurality of attachment clips including a first group of attachment clips and a second group of attachment clips, wherein the retaining fastener of each attachment clip in the first group of attachment clips includes a ridge configured to engage the groove of the first edge of the first building surface panel, and wherein the retaining fastener of each attachment clip in the second group of attachment clips includes a notch configured to receive the tongue of the second edge of the first building surface panel.

Embodiment 25. The building surface panel kit according to embodiment 24, further comprising a plurality of additional building surface panels configured to be secured to a support structure using the plurality of attachment clips.

Embodiment 26. The building surface panel kit according to any of embodiments 1 to 25, further comprising a first connector clip including:

a base wall, and a first projection extending laterally from a first side of the base wall; and wherein the first building surface panel includes a hollow structural body including a first perimeter wall section at the first end that surrounds a recess configured to receive the first projection of the first connector clip.

Embodiment 27. The building surface panel kit according to embodiment 26, wherein the first projection of the first connector clip includes a plurality of projection portions that are separated by gaps along a height of the first connector clip.

Embodiment 28. The building surface panel kit according to embodiment 26 or embodiment 27, wherein the structural body of the first building surface panel includes at least one web extending between the front face and the rear face.

Embodiment 29. The building surface panel kit according to any of embodiments 26 to 28, wherein the first projection includes a plurality of tabs extending from the base wall.

Embodiment 30. The building surface panel kit according to any of embodiments 26 to 29, wherein the first projection of the first connector clip is configured to form a friction fit in the recess of the first building surface panel.

Embodiment 31. The building surface panel kit according to any of embodiments 26 to 30, wherein the first projection includes a protrusion configured to form a snap-fit connection in a recess of the first building surface panel.

Embodiment 32. A method of securing a building surface panel kit according to any of embodiments 1 to 31 to a support structure, the method comprising:

attaching a first group of attachment clips to a support structure, each of the attachment clips in the first group of attachment clips having a retaining fastener including a ridge configured to engage a groove of a building surface panel;

securing a first building surface panel to the first group of attachment clips by placing the ridge of each attachment clip into a groove on a first edge of the first building surface panel;

securing a second group of attachment clips to a second edge of the first building surface panel, each of the attachment clips in the second group of attachment clips having a retaining fastener including a notch, wherein securing the second group of attachment clips to the second edge of the first building surface panel includes placing a tongue located on the second edge of the first building surface panel into each notch of a respective attachment clip of the second group of attachment clips; and attaching the second group of attachment clips to the support structure.

Embodiment 33. The method according to embodiment 32, further comprising securing a second building surface panel to the first building surface panel by inserting the tongue located on the second edge of the first building surface panel into a groove on a first edge of the second building surface panel.

Embodiment 34. The method according to embodiment 33, further comprising securing a third group of attachment clips to a second edge of the second building surface panel, each of the attachment clips in the third group of attachment clips having a retaining fastener including a notch, wherein securing the third group of attachment clips to the second edge of the second building surface panel includes placing a tongue located on the second edge of the second building surface panel into each notch of a respective attachment clip of the third group of attachment clips; and attaching the third group of attachment clips to the support structure.

Embodiment 35. The method according to any of embodiments 32 to 34, wherein attaching the attachment clips to the support structure includes extending a mechanical fastener through a respective aperture in each of the attachment clips and into the support structure.

Embodiment 36. A building surface panel system comprising a first building surface panel secured to a support structure via a first group of attachment clips and a second group of attachment clips, the building surface panel, the first group of attachment clips and the second group of attachment clips, and their association with one another and with the support structure being as described above with reference to any of embodiments 1-35.

Embodiment 37. A building surface panel system comprising a building surface panel kit as described with reference to any of embodiments 1-35 secured to a support structure, wherein the attachment platform of the first connector clip is attached to a surface of the support structure, and wherein the first projection of the first connector clip is disposed in the recess at the first end of the first building surface panel.

Embodiment 38. A building surface panel kit for attachment to a support structure, the building surface panel kit comprising:

a first connector clip including:

an attachment platform configured to be secured to the support structure, a base wall secured to the attachment platform, and a first projection extending laterally from a first side of the base wall; and a first building surface panel having a first end, a second end, a first side, a second side, a front face, and a rear face, the first building surface panel comprising a structural body including a first perimeter wall section at the first end that surrounds a recess configured to receive the first projection of the first connector clip.

Embodiment 39. The building surface panel kit according to embodiment 38, wherein the first building surface panel is hollow and the first perimeter wall section is part of a perimeter wall that extends the length of the panel.

Embodiment 40. The building surface panel kit according to embodiment 38 or embodiment 39, wherein the structural body of the first building surface panel is an extruded member that includes the first perimeter wall section.

Embodiment 41. The building surface panel kit according to any of embodiments 38 to 40, wherein the first projection of the first connector clip includes a plurality of projection portions that are separated by gaps along a height of the first connector clip.

Embodiment 42. The building surface panel kit according to any of embodiments 38 to 41, wherein the structural body of the first building surface panel includes at least one web extending between the front face and the rear face.

Embodiment 43. The building surface panel kit according to embodiment 42, wherein each web of the at least one web is configured to be received in a respective gap between the projection portions.

Embodiment 44. The building surface panel kit according to any of embodiments 38 to 43, wherein the first projection of the first connector clip is hollow.

Embodiment 45. The building surface panel kit according to any of embodiments 38 to 44, wherein the first projection includes a plurality of tabs extending from the base wall.

Embodiment 46. The building surface panel kit according to any of embodiments 38 to 45, wherein the first building surface panel includes a tongue along the first side and a groove along the second side.

Embodiment 47. The building surface panel kit according to embodiment 46, wherein the first projection of the first connector clip includes a slot configured to accommodate the groove of the first building surface panel.

Embodiment 48. The building surface panel kit according to embodiment 46 or embodiment 47, wherein the base wall of the first connector clip includes a notch configured to accommodate a tongue of an adjacent building surface panel.

Embodiment 49. The building surface panel kit according to any of embodiments 38 to 48, wherein the first connector clip includes an aperture through the attachment platform that is configured to receive a mechanical fastener for securing the first connector clip to the support structure.

Embodiment 50. The building surface panel kit according to embodiment 49, wherein the aperture is a slot so as to allow the first connector clip to move laterally along the support structure.

Embodiment 51. The building surface panel kit according to embodiment 49 or embodiment 50, wherein the aperture through the attachment platform is positioned further from the base wall than a distal end of the first projection.

Embodiment 52. The building surface panel kit according to embodiment 49 or embodiment 50, wherein the first projection of the first connector clip includes a plurality of projection portions that are separated by gaps along a height of the first connector clip, and wherein the aperture through the attachment platform is aligned with a respective gap in the first projection.

Embodiment 53. The building surface panel kit according to any of embodiments 49 to 52, wherein the attachment platform comprises a first portion and a second portion that is connectable to the first portion, wherein the base wall is secured to the first portion and the aperture extends through the second portion.

Embodiment 54. The building surface panel kit according to any of embodiments 38 to 53, wherein the front face of the first building surface panel includes a textured contour.

Embodiment 55. The building surface panel kit according to embodiment 54, wherein the textured contour replicates a cut wooden plank.

Embodiment 56. The building surface panel kit according to any of embodiments 38 to 55 wherein the first projection of the first connector clip is configured to form a friction fit in the recess of the first building surface panel.

Embodiment 57. The building surface panel kit according to any of embodiments 38 to 55, wherein the first projection includes a protrusion for forming a snap fit connection in the recess of the first building surface panel.

Embodiment 58. The building surface panel kit according to embodiment 57, wherein the recess at the first end of the first building surface panel includes a catch to receive the protrusion.

Embodiment 59. The building surface panel kit according to any of embodiments 38 to 58, wherein the first connector clip is a joint connector clip and further comprises a second projection extending laterally from a second side of the base wall in a direction that is opposite the first projection.

Embodiment 60. The building surface panel kit according to embodiment 59, further comprising a second building surface panel having a first end, a second end, a first side, a second side, a front face, and a rear face, the second building surface panel comprising a structural body including a first perimeter wall section at the second end that surrounds a recess configured to receive the second projection of the first connector clip.

Embodiment 61. The building surface panel kit according to embodiment 59 or embodiment 60, wherein the base wall is formed by a single plate, and wherein the first projection extends from a first side of the plate and the second projection extends from a second side of the plate.

Embodiment 62. The building surface panel kit according to embodiment 57 or embodiment 60, wherein the base wall includes a first plate and a second plate, and wherein the first projection extends from the first plate and the second projection extends from the second plate.

Embodiment 63. The building surface panel kit according to embodiment 62, wherein a distance between the first plate and the second plate is adjustable.

Embodiment 64. The building surface panel kit according to embodiment 63, wherein the attachment platform includes a first portion and a second portion that is connectable to the first portion, wherein the first plate of the base wall is secured to the first portion of the attachment platform and the second plate of the base wall is secured to the second portion of the attachment platform, and wherein the first portion and the second portion of the attachment platform are connectable in a plurality of positions.

Embodiment 65. The building surface panel kit according to any of embodiments 38 to 58, wherein the first connector clip is an end connector clip, and wherein a second side of the base wall that is opposite the first side is substantially flat.

Embodiment 66. The building surface panel kit according to any of embodiments 38 to 65, further comprising a plurality of additional building surface panels and a plurality of additional connector clips configured to secure the building surface panels to one another and to the support structure.

Embodiment 67. A building surface panel system comprising:

a support structure; and a building surface panel kit according to any of embodiments 38 to 66 secured to the support structure, wherein the attachment platform of the first connector clip is attached to a surface of the support structure, and wherein the first projection of the first connector clip is disposed in the recess at the first end of the first building surface panel.

Embodiment 68. The building surface panel system according to embodiment 67, further comprising a second building surface panel having a first end, a second end, a first side, a second side, a front face, and a rear face, the second building surface panel comprising a structural body including a perimeter wall including a first perimeter wall section at the first end that surrounds a first recess and a second perimeter wall section at the second end that surrounds a second recess, wherein the first connector clip includes a second projection extending laterally from the base wall in a second direction that is opposite the first direction, and wherein the second projection of the first connector clip is disposed in the second recess at the second end of the second building surface panel.

Embodiment 69. The building surface panel system according to embodiment 67, further comprising a second connector clip including:

an attachment platform secured to the support structure, a base wall secured to the attachment platform, and a first projection extending laterally from a first side of the base wall, wherein the first projection of the second connector clip is disposed in the first recess at the first end of the second building surface panel.

Embodiment 70. The building surface panel system according to embodiment 69, wherein the second connector clip is an end connector clip, and wherein a second side of the base wall of the second connector clip is substantially flat.

Embodiment 71. The building surface panel system according to embodiment 69 or embodiment 70, wherein a trim element covers the second connector clip.

Embodiment 72. The building surface panel system according to embodiment 69, wherein the second connector clip is a joint connector clip and includes a second projection extending laterally from a second side of the base wall in a direction opposite the first projection.

Embodiment 73. The building surface panel system according to embodiment 72, further comprising a third building surface panel, wherein the second projection of the second connector clip is disposed in a recess in the third building surface panel.

Embodiment 74. The building surface panel system according to embodiment 72 or embodiment 73, wherein the base wall of the first connector clip is formed by a single plate with the first projection of the first connector clip extending from a first side of the single plate and the second projection of the first connector clip extending from a second side of the single plate, and wherein the base wall of the second connector clip includes a first plate and a second plate with the first projection of the second connector clip extending from the first plate and the second projection of the second connector clip extending from the second plate.

What is claimed is:

1. An attachment clip configured to attach an article to a structure, the article having a length extending in a first direction from a first end thereof to a second end thereof, the article having a front face, a rear face, and a first edge that extends in the first direction and includes a groove that extends in the first direction along the first edge, the attachment clip comprising:

a clip body, a first arm extending laterally from the clip body, configured to extend laterally from the clip body in the first direction, an attachment surface coupled to the clip body and configured to be secured to the structure, and a retaining fastener coupled to the clip body and configured to engage the edge of the article, the retaining fastener including a ridge disposed on the first arm that is configured to engage the groove of the first edge of the article.

2. The attachment clip of claim 1, wherein the clip body has an aperture formed therein, the aperture being configured to receive a mechanical fastener through which the attachment clip can be attached to the structure.

3. The attachment clip of claim 2, wherein the aperture extends from a front face of the clip body to the attachment surface.

4. The attachment clip of claim 1, wherein the attachment clip further includes a foot attached to the clip body, and wherein the attachment surface is disposed on the foot.

5. The attachment clip of claim 4, wherein the foot extends outward from the clip body.

6. A kit of attachment clips configured to attach a first article to a structure, the first article having a first edge and a second edge each extending in a first direction, the first article including a groove extending in the first direction along the first edge of the first article and, extending along the second edge of the first article, a tongue configured to be inserted into the groove of another such article, the kit comprising:

a plurality of first attachment clips, each according to claim 1; and a plurality of second attachment clips, each comprising:

a clip body, an attachment surface coupled to the clip body and configured to be secured to the structure; and a retaining fastener comprising a notch configured to engage the edge of the article, the retaining fastener including a notch configured to receive the tongue of the second edge of the article, wherein the notch is formed between two retaining walls that extend from the clip body.

7. A method of securing to a structure an article having an edge and a groove that extends in a first direction along the edge of the article, the method comprising:

attaching a plurality of attachment clips according to claim 1 to the structure; and securing the article to the structure by engaging the groove at the edge of the article with the ridge of each of the plurality of attachment clips.

8. A method of securing to a structure an article having a first edge, a groove that extends in a first direction along the first edge, a second edge, and a tongue that extends in the first direction along the second edge, the method comprising:

providing a kit of attachment clips according to claim 6;

attaching a plurality of the first attachment clips to the structure;

attaching a plurality of the second attachment clips to the structure; and securing the article to the structure by engaging the groove at the first edge of the article with the ridge of each of the plurality of first attachment clips, and engaging the tongue at the second edge of the article with the notch of each of the plurality of second attachment clips.

9. A system comprising:

a structure;

an article having a length extending in a first direction from a first end thereof to a second end thereof, the article having a front face, a rear face, and a first edge that extends in the first direction and includes a groove that extends in the first direction along the first edge; and an attachment clip according to claim 1, the first arm of the attachment clip extending laterally from the clip body in the first direction, the attachment surface of the attachment clip being secured to the structure, and the ridge of the retaining fastener of the attachment clip engaging the groove of the first edge of the article.

10. The system according to claim 9, wherein the article further includes a rear wall disposed adjacent the structure and having an opening formed therein along the first edge thereof, and a gap in the groove extending along the opening, wherein the attachment clip is disposed in the opening of the rear wall of the article.

11. The system according to claim 9, wherein the article is a building surface panel.

12. A system, comprising:

a structure;

a first article having a first edge and a second edge each extending in a first direction, the first article including a groove extending in the first direction along the first edge of the first article and, extending along the second edge of the first article, a tongue configured to be inserted into the groove of another such article; and a first attachment clip according to claim 1, the first arm of the first attachment clip extending laterally from the clip body in the first direction, the attachment surface of the first attachment clip being secured to the structure, and the ridge of the retaining fastener of the first attachment clip engaging the groove of the first edge of the article; and a second attachment clip, comprising:

a clip body, an attachment surface coupled to the clip body and secured to the structure; and a retaining fastener comprising a notch receiving the tongue of the second edge of the article, wherein the notch is formed between two retaining walls that extend from the clip body.

13. The system according to claim 12, wherein the first article further includes a rear wall disposed adjacent the structure and having an opening formed therein along the first edge thereof, and a gap in the groove extending along the opening, wherein the attachment clip is disposed in the opening of the rear wall of the first article.

14. The system according to claim 12, wherein the first article is a building surface panel.

15. The system according to claim 12, further comprising:

a second article, the second article having a first edge and a second edge each extending in a first direction, the second article including a groove extending in the first direction along the first edge of the second article and a tongue extending along the second edge of the second article, the tongue of the first article being disposed in the groove of the second article, the second article further including a rear wall disposed adjacent the structure and having an opening formed therein along the first edge thereof, a gap in the groove extending along the opening, wherein the second attachment clip is disposed in the opening of the rear wall of the second article, and wherein the notch of the second attachment clip and the groove of the second article form a channel that receives the tongue of the first article.

16. A system, comprising:

a structure;

a first article, the first article having a first edge and a second edge each extending in a first direction, the first article including a groove extending in the first direction along the first edge of the first article and a tongue extending along the second edge of the first article;

a second article, the second article having a first edge and a second edge each extending in a first direction, the second article including a groove extending in the first direction along the first edge of the second article and a tongue extending along the second edge of the second article, the tongue of the first article being disposed in the groove of the second article, the second article further including a rear wall disposed adjacent the structure and having an opening formed therein along the first edge thereof, a gap in the groove extending along the opening; and an attachment clip disposed in the opening of the rear wall of the second article, the attachment clip comprising a clip body, an attachment surface coupled to the clip body and secured to the structure; and a retaining fastener comprising a notch formed between two retaining walls that extend from the clip body, wherein the notch of the attachment clip and the groove of the second article form a channel that receives the tongue of the first article.

17. The system of claim 16, wherein the first article is a first building surface panel, and the second article is a second building surface panel.

* * * * *